US011547635B2

(12) United States Patent
Snow et al.

(10) Patent No.: US 11,547,635 B2
(45) Date of Patent: Jan. 10, 2023

(54) ENTERAL FEEDING SYSTEM

(71) Applicant: LactaLogics, Inc., Port Saint Lucie, FL (US)

(72) Inventors: Glenn Wayne Snow, Port Saint Lucie, FL (US); Laura Jane Salter, Port Saint Lucie, FL (US)

(73) Assignee: LACTALOGICS, INC., Port Sant Lucie, FL (US)

( * ) Notice: Subject to any disclaimer, the term of this patent is extended or adjusted under 35 U.S.C. 154(b) by 0 days.

(21) Appl. No.: 17/699,110

(22) Filed: Mar. 19, 2022

(65) Prior Publication Data

US 2022/0211585 A1 Jul. 7, 2022

Related U.S. Application Data

(63) Continuation of application No. 17/403,877, filed on Aug. 16, 2021.

(60) Provisional application No. 63/066,486, filed on Aug. 17, 2020.

(51) Int. Cl.
*A61J 11/00* (2006.01)

(52) U.S. Cl.
CPC ..... *A61J 11/008* (2013.01); *A61J 11/005* (2013.01); *A61J 11/0005* (2013.01)

(58) Field of Classification Search
CPC ..... A61J 11/008; A61J 11/0005; A61J 11/005
See application file for complete search history.

(56) References Cited

U.S. PATENT DOCUMENTS

| | | | | |
|---|---|---|---|---|
| 5,024,341 | A * | 6/1991 | Dekerle | A61J 11/04 D9/557 |
| 6,415,937 | B1 * | 7/2002 | DeJong | A61J 11/04 215/11.1 |
| 6,612,428 | B1 * | 9/2003 | Segovia, Jr | B65D 75/5883 206/219 |
| 6,814,229 | B2 * | 11/2004 | Seckier | A61J 9/00 206/217 |
| 6,851,565 | B2 * | 2/2005 | Stephan | A61J 11/04 215/11.1 |
| 7,661,546 | B2 * | 2/2010 | Jiang | A61J 11/04 215/11.1 |
| 8,100,276 | B2 * | 1/2012 | Moor | A61J 11/002 215/11.1 |
| 9,855,194 | B1 * | 1/2018 | Walter, Jr. | A61J 11/0095 |
| 2009/0120894 | A1 * | 5/2009 | Kario | B65D 77/30 215/11.1 |

* cited by examiner

*Primary Examiner* — Tri M Mai
(74) *Attorney, Agent, or Firm* — The Watson IP Group, PLC; Jovan N. Jovanovic

(57) ABSTRACT

A dispensing cap comprising a grasping body, a spout engaging bore and a dispensing coupling. The dispensing coupling has a dispensing cap coupled thereto through a tether. A pouch assembly is likewise disclosed, as is a process of enteral feeding with a pouch and a dispensing cap attachable to the spout. The dispensing cap can be provided and attached to a spout of a pouch (upon removal of a filling cap) wherein the dispensing cap may be provided in a sterilized bag or pouch prior to use. Methods and processes are likewise disclosed.

16 Claims, 25 Drawing Sheets

ENTERAL FEEDING SYSTEM

CROSS-REFERENCE TO RELATED APPLICATION

This present application is a continuation of U.S. patent application Ser. No. 17/403,877 filed on Aug. 16, 2021, entitled "ENTERAL FEEDING SYSTEM", which claims priority from U.S. Provisional Patent App. Ser. No. 63/066,486 filed Aug. 17, 2020, entitled "Enteral Feeding System", the entire specification of which is hereby incorporated by reference in its entirety.

BACKGROUND OF THE DISCLOSURE

1. Field of the Disclosure

The disclosure relates in general to an enteral feeding system, and more particularly, to a cap for a pouch utilizable for eternal feeding, a pouch with a cap utilizable for eternal feeding and a method of using a cap for a pouch.

2. Background Art

Enteral feeding is well known in the art. Depending on the patient, the circumstances and other considerations, enteral feeding is utilized to directly feed a patient directly or indirectly into the stomach through, for example a feeding tube which may dispense from a package or a syringe.

One such instance is for the feeding of infants, and often times prematurely born infants. Typically, a user will draw a volume of real or artificial breast milk (i.e., formula or the like) into a syringe and then couple the syringe to a feeding tube. While such solutions successfully deliver nourishment to the stomach of an infant, there are drawbacks.

In many instances, the container from which the syringe draws fluid has a relatively large opening, and, as such, contamination and contaminants can enter into the larger container. Furthermore, such contamination even with air or oxygen can lead to oxidation of milk lipids and the like. Often times, the container can be utilized for an entire day, or more, through multiple feedings. In other instances, it is easy to spill or otherwise compromise or destroy the fluid that is being dispensed.

While not limited thereto, it is likewise it is desirable to simplify compliance with a closed-system, aseptic administration, and shelf-stable products, that can make human milk (among other liquids and the like) easy to administer.

SUMMARY OF THE DISCLOSURE

The disclosure is directed a dispensing cap comprising a grasping body, a spout engaging bore and a dispensing coupling. The dispensing coupling has a dispensing cover that is coupled to the grasping body through a tether.

The disclosure is directed a dispensing cap comprising a grasping body, a spout engaging bore and a dispensing coupling. The dispensing coupling has a dispensing cover that is coupled to the grasping body through a tether.

In another aspect of the disclosure, the disclosure is directed to a pouch assembly that includes a pouch and a dispensing cover. The pouch has a pouch body defining a volume and a spout providing communication with the volume. The dispensing cover is attachable to the volume and having a dispensing coupling with a dispensing cover coupled thereto through a tether.

In another aspect of the disclosure, the disclosure is directed to a process for enteral feeding with a pouch and a dispensing cap attachable to the spout.

In another aspect of the disclosure, the disclosure is directed to a pouch assembly comprising a pouch and a dispensing cap. The pouch includes a pouch body being flexible and defining a volume with a spout providing fluid communication with the volume. The dispensing cap is coupled to the spout in fixed engagement. The dispensing cap includes a grasping body, a spout engaging bore, a spout engaging end and a dispensing coupling. The grasping body has an outer surface. The spout engaging bore is structurally configured to engage the spout. The spout engaging end extends from the bore and has an outlet opening that is in fluid communication with the spout, and in turn, the volume. The dispensing coupling extends from the spout engaging end, with the dispensing coupling in fluid communication with the outlet opening.

In some configurations, the dispensing coupling comprises an EnFit coupling.

In some configurations, the dispensing cap further includes a dispensing cover positionable to overlie the dispensing coupling.

In some configurations, the assembly further includes a tether attaching, at a first end, the grasping body, and at a second end, the dispensing cap.

In some configurations, the cap further includes one of a finger and a finger pull ring extending therefrom to facilitate a disconnecting of the dispensing cap from the dispensing coupler. In some such configurations, a frangible seal is configured to retain the dispensing cap on the dispensing cover.

In some configurations, the dispensing cap comprises a flip-top cover coupled to the grasping body through a live hinge configuration.

In some configurations, the assembly further includes a biasing member extending between the flip-top cover and the grasping body to limit the opening of the live hinge configuration.

In some configurations, the pouch assembly further includes an outer flange extending from the spout engaging end. The flip-top cover includes an outer rim. The outer flange and the outer rim interface in a closed configuration.

In some configurations, the pouch assembly includes at least one of a finger and a finger pull ring extending therefrom to facilitate an opening of the flip-top cover about the live hinge-configuration.

In some configurations, the EnFit coupling further includes an elongated bore with an outer surface. The outer surface includes a frustoconical portion extending from the spout engaging end and terminating at a beveled portion.

In some configurations, the EnFit coupling further includes an outer shell having an inner surface and an outer surface. The outer shell extends from the spout engaging end, and surrounds the elongated bore, spaced apart from the outer surface thereof. A thread extends about the outer surface of the outer shell.

In some configurations, the grasping body further includes an annular hoop surrounding the spout engaging end. The annular hoop includes an annular wall, with an upstanding wall extending from the annular wall terminating at an upper rim, and including an outer surface, with a body thread positioned along the outer surface. The pouch assembly further includes a nipple assembly which includes a nipple member and a retention ring. The nipple member includes a base flange and an upper funnel portion defining an upper opening and a lower opening. The retention ring has an upper wall with a lower surface and a depending wall depending from the upper wall and including a retaining thread. The retention ring, in cooperation with the annular hoop, sandwich the nipple member therebetween, while placing the upper opening and the lower opening in fluid communication with the outlet opening of the spout engaging bore.

In come configurations, the annular hoop further includes an inner wall depending from the annular wall and an outer wall depending from the annular wall radially spaced apart from the inner wall. An inner connecting flange extends from the spout engaging bore to the inner wall.

In some configurations, the inner wall, the spout engaging bore and the inner connecting flange define a trough that extends about the spout engaging bore.

In some configurations, the outer wall of the retention ring and the outer wall of the annular hoop substantially correspond.

In some configurations, the pouch assembly further comprises a dispensing coupling extending from the spout engaging end. The dispensing coupling has an elongated bore with an outer surface. The outer surface includes a frustoconical portion and a beveled portion at a distal end thereof.

In some configurations, the dispensing coupling further includes an outer shell extending around the outer surface.

In some configurations, human breast milk is placed in the volume of the pouch.

In another aspect of the disclosure, the disclosure is directed to a dispensing cap for attachment to a pouch. The dispensing cap comprises a grasping body, a spout engaging bore, a spout engaging end and a dispensing coupling. The grasping body has an outer surface. The spout engaging bore is structurally configured to engage the spout. The spout engaging end extends from the bore and has an outlet opening that is in fluid communication with the spout, and in turn, the volume. The dispensing coupling extends from the spout engaging end. The dispensing coupling is in fluid communication with the outlet opening.

The dispensing cap may include any of the features or combination of features set forth above or herein.

In another aspect of the disclosure, the disclosure is directed to a dispensing cap for attachment to a pouch. The dispensing cap has a grasping body, a spout engaging bore, a spout engaging end, a dispensing coupling and a nipple assembly. The grasping body has an outer surface. The spout engaging bore is structurally configured to engage the spout. The spout engaging end extends from the bore and having an outlet opening that is in fluid communication with the spout, and in turn, the volume. The dispensing coupling extends from the spout engaging end, with the dispensing coupling being in fluid communication with the outlet opening. The grasping body further includes and an annular hoop surrounding the spout engaging end, the annular hoop including an annular wall, with an upstanding wall extending from the annular wall terminating at an upper rim, and including an outer surface, with a body thread positioned along the outer surface. The nipple assembly has a nipple member and a retention ring. The nipple member includes a base flange and an upper funnel portion defining an upper opening and a lower opening. The retention ring has an upper wall with a lower surface. A depending wall depends from the upper wall and including a retaining thread. The retention ring in cooperation with the annular hoop sandwich the nipple member therebetween, while placing the upper opening and the lower opening in fluid communication with the outlet opening of the spout engaging bore.

In some configurations, the annular hoop further includes an inner wall depending from the annular wall and an outer wall depending from the annular wall radially spaced apart from the inner wall, and, an inner connecting flange extending from the spout engaging bore to the inner wall.

In some configurations, the inner wall, the spout engaging bore and the inner connecting flange define a trough that extends about the spout engaging bore.

In some configurations, the outer wall of the retention ring and the outer wall of the annular hoop substantially correspond.

In some configurations, comprising a dispensing coupling extending from the spout engaging end, the dispensing coupling having an elongated bore with an outer surface, the outer surface including a frustoconical portion and a beveled portion at a distal end thereof.

In some configurations, the dispensing coupling further includes an outer shell extending around the outer surface.

In another aspect of the disclosure, the disclosure is directed to a process for enteral feeding with a pouch and a dispensing cap attachable to the spout. The process comprises the steps of: providing a pouch having a spout; attaching a dispensing cap to the spout; and attaching an outside structure to the dispensing cap.

In some configurations, the dispensing cap includes an EnFit connector, and the outside structure comprises one of a syringe and a feeding tube.

In some configurations, the process further comprises the step of removing a filling cap prior to the step of attaching an outside structure to the dispensing cap.

In some configurations, the step of attaching an outside structure comprises the step of attaching a syringe to the dispensing cap.

In some configurations, the step of attaching an outside structure comprises the step of withdrawing fluid from within the pouch with the syringe into the syringe.

In some configurations, the process further comprises the step of hanging the pouch from an outside structure in an inverted configuration after the step of attaching an outside structure to the dispensing cap.

In some configurations, the outside structure comprises a feeding tube.

In some configurations, the outside structure comprises a nipple assembly.

In another aspect of the disclosure, the disclosure is directed to a process for enteral feeding with a pouch and a dispensing cap attachable to the spout, the process comprising the steps: providing a pouch having a spout, the pouch having a volume filled with a fluid; and attaching the dispensing cap having a nipple assembly as set forth above and hereinafter.

In some configurations, the process further includes the steps of: feeding the fluid to a patient; and discarding the pouch with spout and dispensing cap after use.

Additional features, structures, methods and processes, some of which are directed to enteral feeding systems are disclosed herein.

BRIEF DESCRIPTION OF THE DRAWINGS

The disclosure will now be described with reference to the drawings wherein.

DETAILED DESCRIPTION OF THE DISCLOSURE

Figure 1:
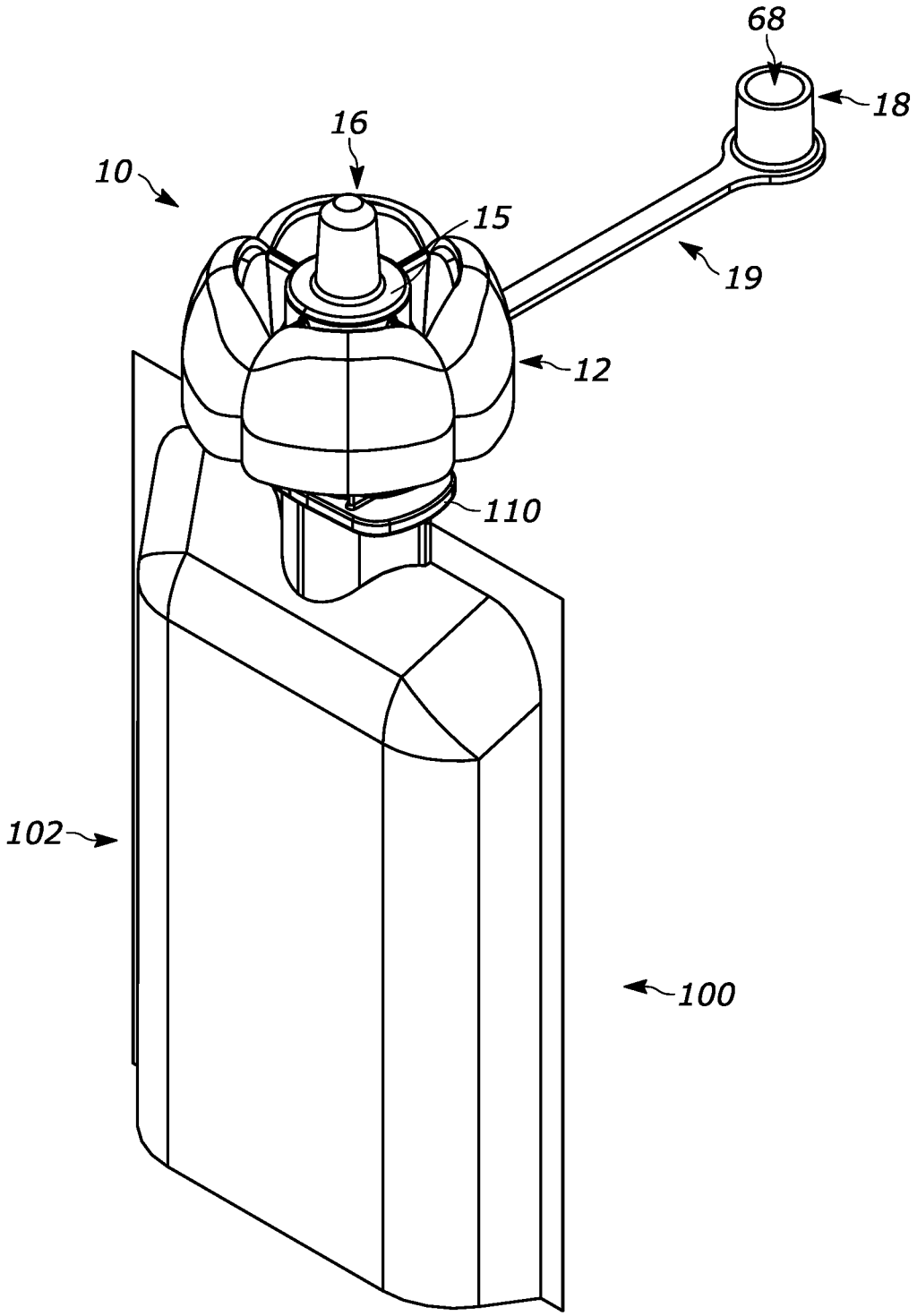
FIG. 1 of the drawings is a perspective view of the pouch having a dispensing cap of the present disclosure, showing, in particular, the coupling thereof.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, a pouch 100 having dispensing cap 10, preferably forming an enteral feeding system is shown. It will be understood that the pouch may be filled with infant formula, breast milk, or other infant nutrient or food liquid or flowable material, as well as meal replacements for infants, babies and adults, typically wherein a feeding tube may be utilized and/or required for feeding. Such a pouch, it is contemplated may be used with the dispensing cap as part of an enteral feeding system. One such system may be configured to provide feeding to an infant (for example, a premature infant), while other uses are contemplated. Among such other uses, the pouch and dispensing cap may be utilized in enteral feeding systems for children and adults, as well as for animals other than humans. Indeed, the components are not limited to such use, but, the system can be very effective for such use.

Figure 2:
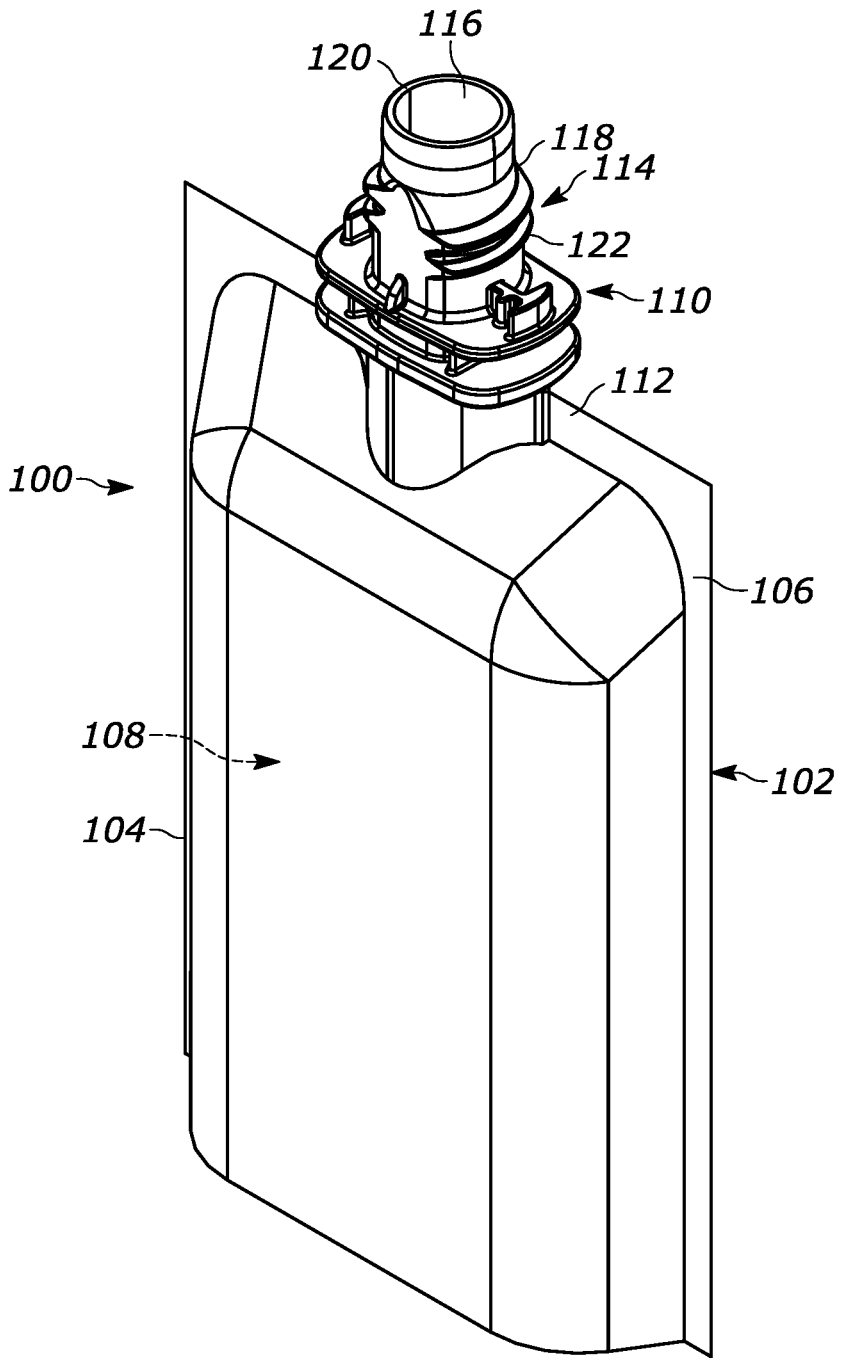
FIG. 2 of the drawings is a perspective view of an exemplary pouch for use in association with the dispensing cap, and with the enteral feeding system of the present disclosure.
Figure 3:
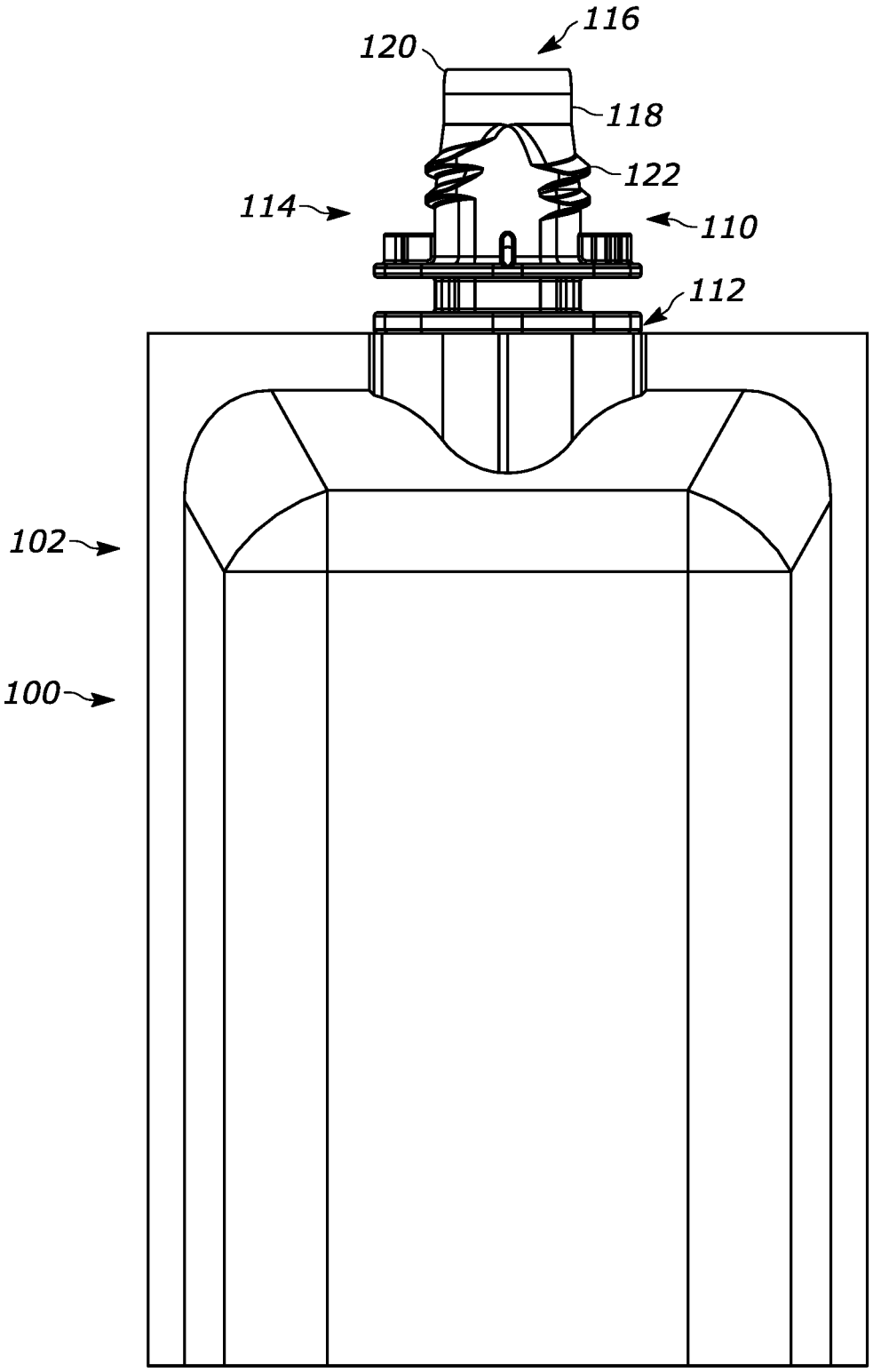
FIG. 3 of the drawings is a side elevational view of an exemplary pouch for use in association with the dispensing cap, and with the enteral feeding system of the present disclosure.
Figure 4:
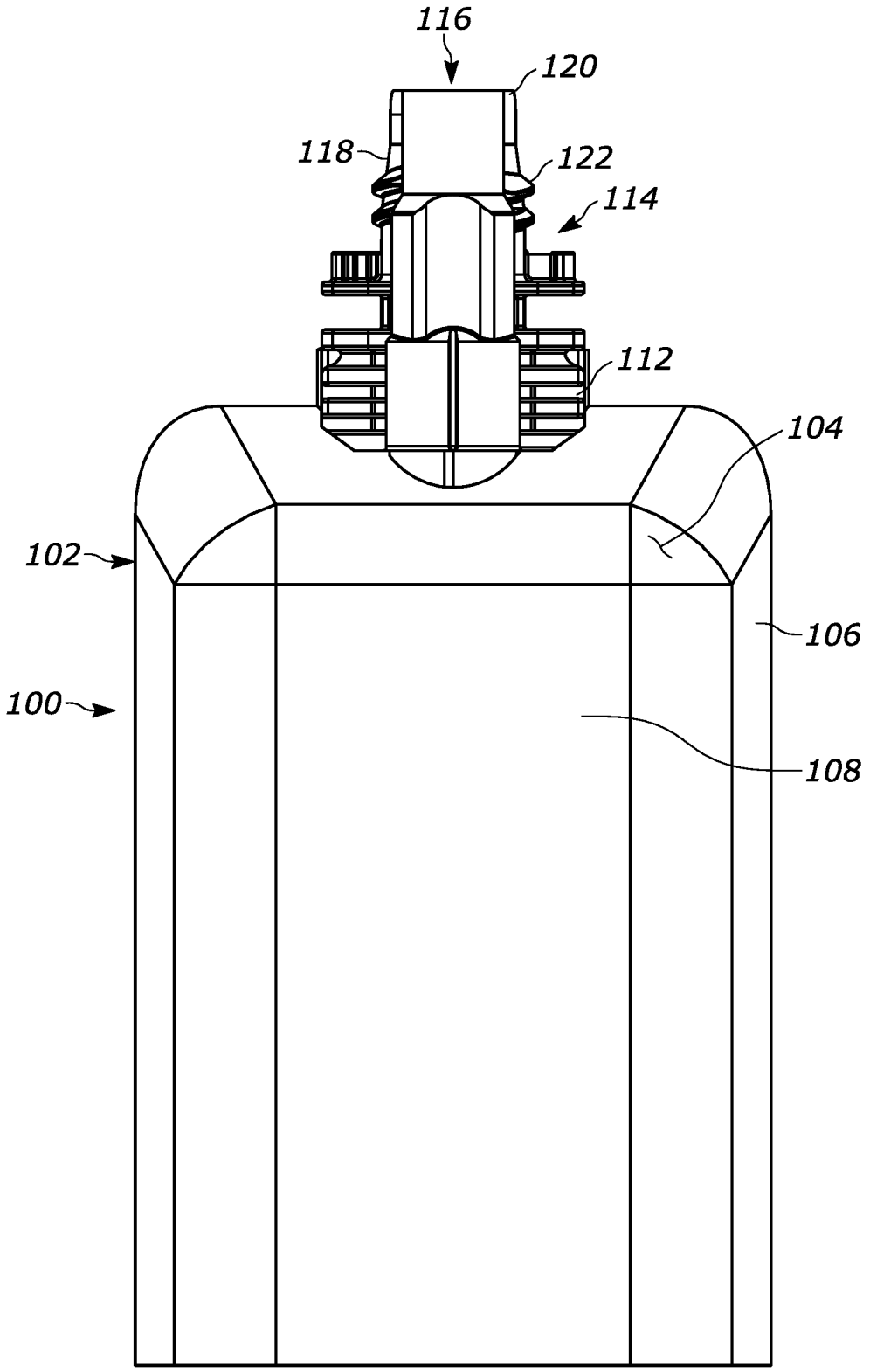
FIG. 4 of the drawings is a cross-sectional view of an exemplary pouch for use in association with the dispensing cap, and with the enteral feeding system of the present disclosure, showing, in particular, the volume of the pouch, and the upper spout body of the spout of the pouch.

With further reference to FIGS. 2 through 4, collectively, the pouch 100 comprises pouch body 102 and spout 110. Such a pouch be of varying size, such as, for example anywhere between two and fifteen ounces (while both larger and smaller sizes are contemplated, depending on the particular application). The pouch body 102 generally comprises a flexible structure defined by a plurality of panels 104 that are coupled together with seals 106 to define a volume 108. A spout 110 is coupled to the pouch body to provide fluid communication with the volume 108 of the pouch body. The pouch body may be formed from polymer films that may comprise one or more layers of material that are coextruded and/or laminated together. Such films may include various treatments and may include metal foils or vapor deposited metals or other elements.

In greater detail, the spout 110 includes base flange 112 and upstanding spout body 114. The spout 110 generally comprises a rigid polymer member that is sealed to the panels or the seams of the pouch body. In the configuration shown, the spout comprises a fin seal spout which is coupled to the pouch between opposing panels in line with a seam. Other spouts are likewise contemplated, including spouts which include, for example bag flanges that are sealingly attached to an inner or outer surface of one or more of the panels.

While not limited to use therewith, some such pouches are disclosed in U.S. Pat. No. 9,751,677 B2 issued to Fiere et al. Other such pouches are sold by ScholleIPN Corporation of Northlake, Ill. under the name CleanPouch, CleanPouchAseptic. The foregoing are solely illustrative and not to be deemed limiting, as other pouches and containers are contemplated for use. Other containers contemplated for use comprise pillow-type containers.

Figure 8:
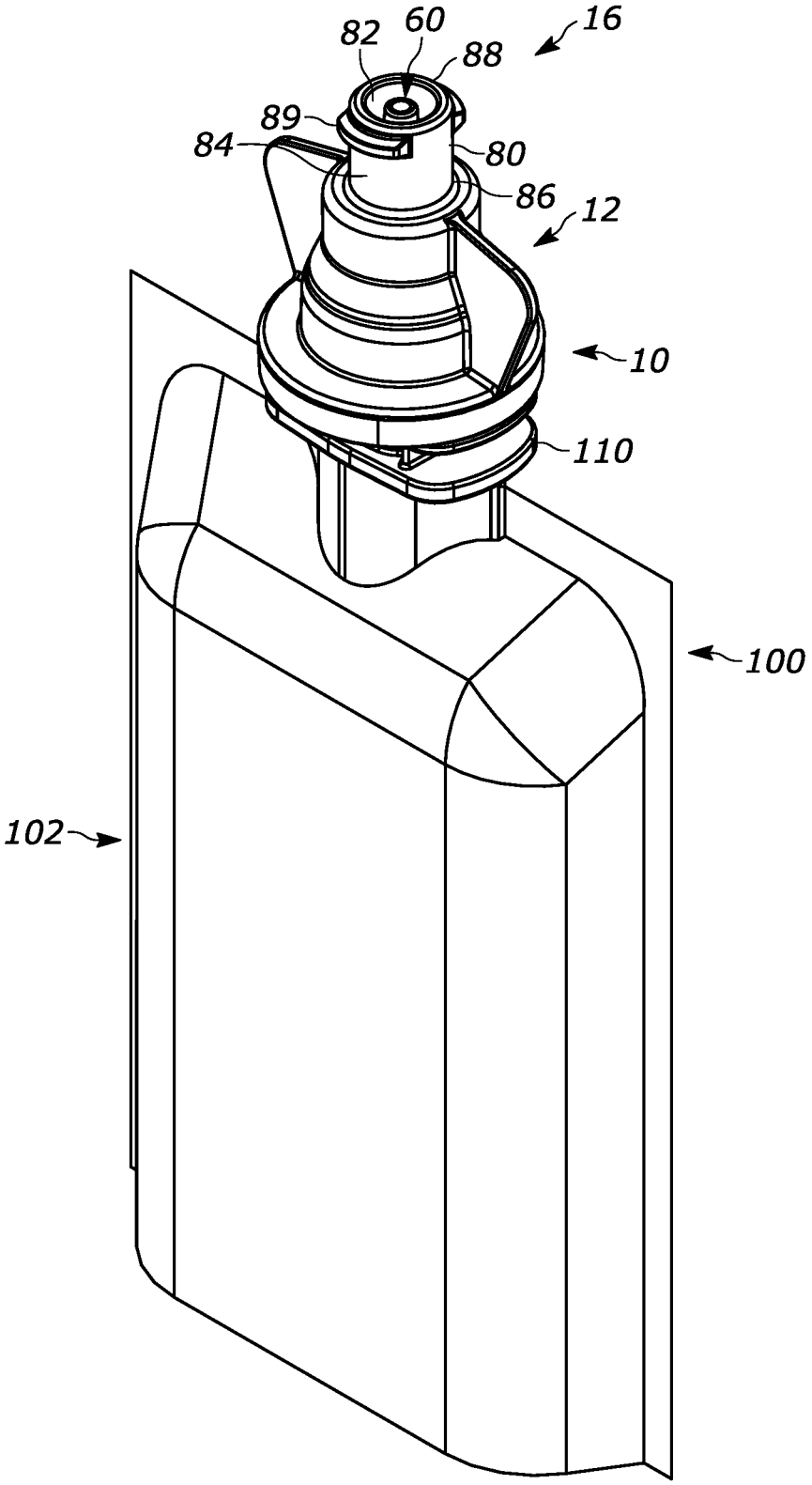
FIG. 8 of the drawings is a perspective view of another exemplary dispensing cap of the present disclosure as coupled to a pouch, showing an alternative configuration of the grasping body and an alternative dispensing coupling having both an elongated bore and an outer shell, and with the understanding that such a configuration may include a dispensing cover and a tether in some configurations.
Figure 9:
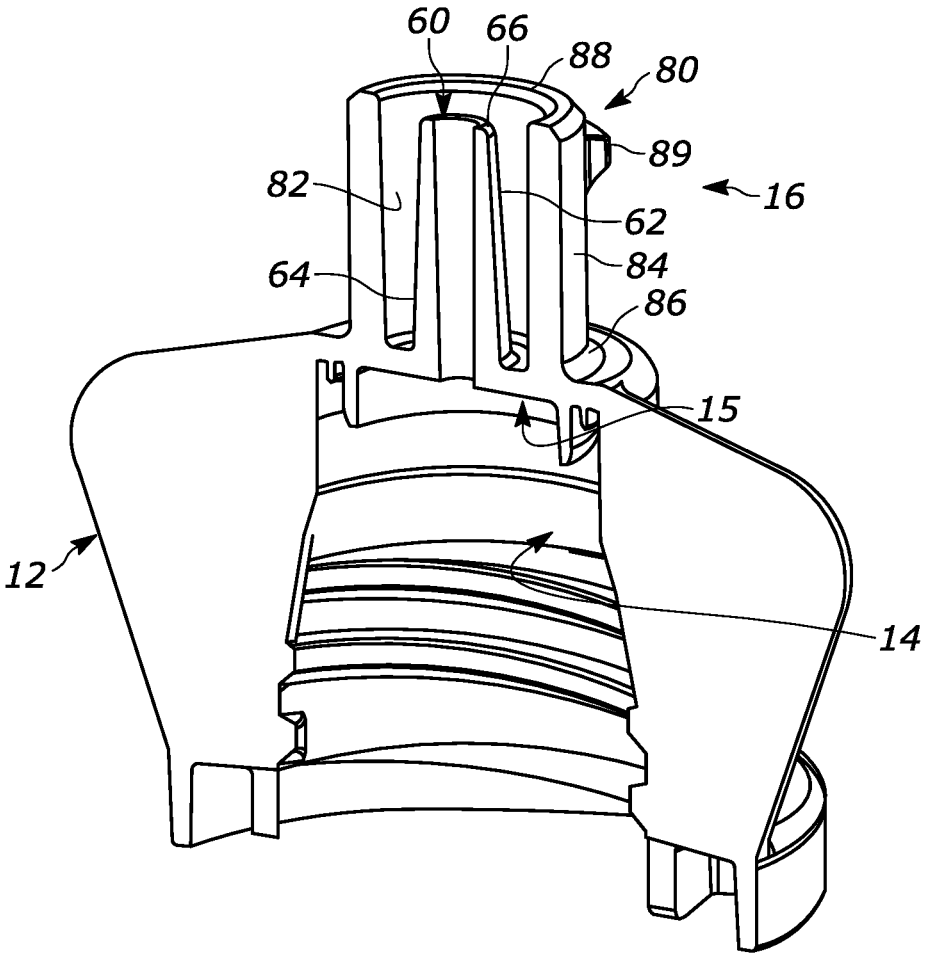
FIG. 9 of the drawings is a perspective cross-sectional view of the exemplary dispensing cap of the disclosure, shown in FIG. 8.

With reference to FIGS. 1, and, 5 through 7, the dispensing cap is shown generally at 10. The dispensing cap comprises grasping body 12, spout engaging bore 14, spout engaging end 15, dispensing coupling 16, dispensing cover 18 and tether 19. Grasping body 12 comprises outer surface 20, and extends from lower end 22 to upper end 24. Typically, the dispensing cap comprises an integrally molded polymer member, however, it is contemplated that the same may be formed from multiple members and coupled together through adhesion, welding or otherwise. In one configuration, the grasping body comprises a generally circular member having surface variations, to form hemispherical configurations, petals, clovers, or the like. The grasping body typically is symmetrical about a central axis of the dispensing cap relative to the spout, and typically has a structure that extends sufficiently away from the central axis of the spout to allow for user retention and rotation thereof relative to the spout (preferably without a tool or an outside object, but, rather, simply with fingers). In other configurations, such as is shown in FIGS. 8 and 9, the grasping body may comprise wings or the like that extend outwardly (in many instances radially outwardly) so as to provide members against which a rotational force or torque can be applied. Such a torque can be applied in either direction to rotate the dispensing cap in either direction.

Referring again to FIGS. 5 through 7, the spout engaging bore 14 includes inner wall surface 30 which extends from lower end 32 to upper end 34. The inner wall includes a spout attachment member, which, in the configuration shown, comprises a thread 37, which is configured to matingly engage the threads 122 of the spout. It will be understood that in other configurations, the spout attachment member may comprise more of a bolt action coupling with a corresponding structure on the upstanding spout body. In still other configurations, the spout attachment member may comprise a tab or detent which can engage a corresponding structure on the outer surface of the upstanding spout body.

The spout engaging end 15 comprises inner surface 40, outer surface 42, inner depending flange 44, slot engaging flange 46 and outlet opening 48. The spout engaging end, in the configuration shown, comprises a substantially planar member that is generally perpendicular to a central axis of the spout, having an inner surface 40 and an outer surface 42. An outlet opening 48 is centrally located and extends through the spout engaging end 15. In the configuration shown, the outlet opening is generally centered about the central axis of the spout, as a single opening. Of course, variations are contemplated, including in location as well as number and shape of the opening.

The inner depending flange 44 includes an inner surface 50 and an outer surface 52. The outer surface 52 interfaces with the upstanding spout body about the upper opening 116. In some configurations, the interface may comprise a sealed engagement therebetween. To assist with the cooperation between components, the lower end of the outer surface may be chamfered to facilitate engagement and to minimize obstruction therebetween.

The slot engaging flange 46 depends from the inner surface 40 of the spout engaging end 15. The slot engaging flange interfaces with (and may sealingly engage) the circumferential slot 120 of the spout 110. It will be understood that the slot engaging flange may be slightly angled radially outwardly so that engagement with the circumferential slot 120 pushes the slot engaging flange 46 in a radially outward direction so as to facilitate slightly biased engagement and to provide enhanced sealing therebetween.

The dispensing coupling 16 is shown as comprising outer surface 62 and elongated bore 60 extending therethrough. The outer surface 62 may include a frustoconical portion 64 and a beveled portion 66 at the upper end thereof to facilitate engagement with an outside device. In the configuration shown, the cross-sectional area of the elongated bore 60 is larger than the cross-sectional area of the outlet opening 48. In other configurations, the two can be matched or can have an alternate relationship. It will be understood that one such a dispensing coupling is known as the EnFit coupling of an EnFit connection system. In the particular configuration shown, the EnFit coupling comprises a male connection system. Such connectors are covered, for example, under ISO 80369, and more particularly, under ISO 80369-3, the entire contents of the standards is hereby incorporated by reference in its entirety. It will be understood that couplings other than the EnFit that, preferably, may be utilized for enteral feeding are likewise contemplated, and that the disclosure is not limited only to such couplings as the EnFit.

In other configurations, such as the configuration of FIGS. 8 and 9, an outer shell 80 may encircle the elongated bore 60. In such a configuration, the outer shell 80 is generally concentric about the elongated bore 60 and includes inner surface 82 (which is radially spaced apart from the outer surface 62), outer surface 84, lower end 86 and upper end 88. The upper end 88 generally terminates correspondingly with the beveled portion 66 in matching correspondence. The outer surface 84 may further include an attachment member 89, such as threads which can matingly engage other outside structures, such as feeding tubes and the like. Again, as with the elongated bore 60 of the dispensing coupling 16, the outer shell may also be an EnFit coupling of an EnFit connection system. Cooperatively, the two form a female/male EnFit coupling of an Enfit connection system. Such a configuration is useful, as it tends to be a standard that is utilized throughout the enteral feeding systems. It will be understood that the outer shell configuration can be adapted to any of the other dispensing caps of the present disclosure.

Figure 5:
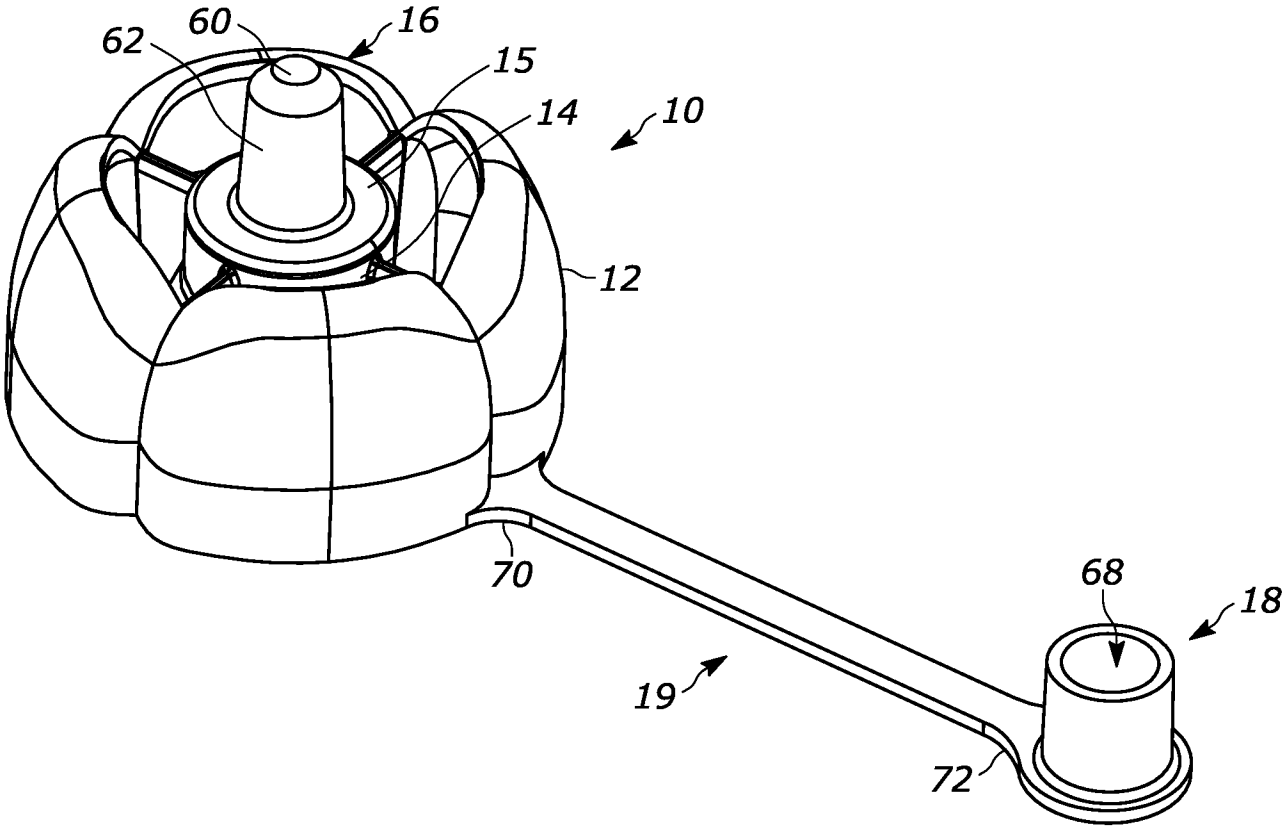
FIG. 5 of the drawings is a perspective view of an exemplary dispensing cap structurally configured for use in association with the present enteral feeding system.
Figure 6:
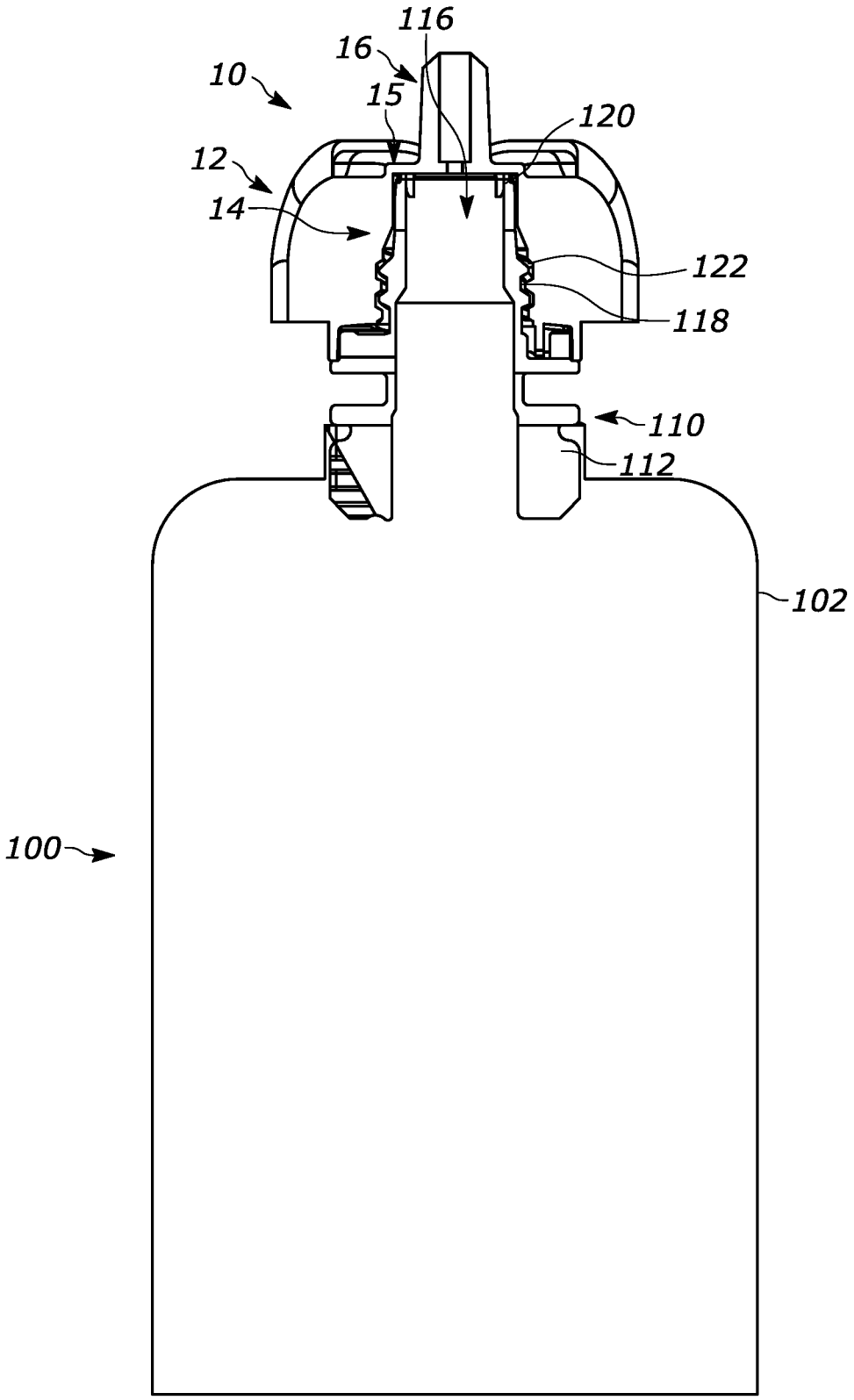
FIG. 6 of the drawings is a cross-sectional view of an exemplary dispensing cap coupled to a pouch structurally configured for use in association with the enteral feeding system of the present disclosure, showing the passages in fluid communication to dispense fluid from within the volume of the pouch.
Figure 7:
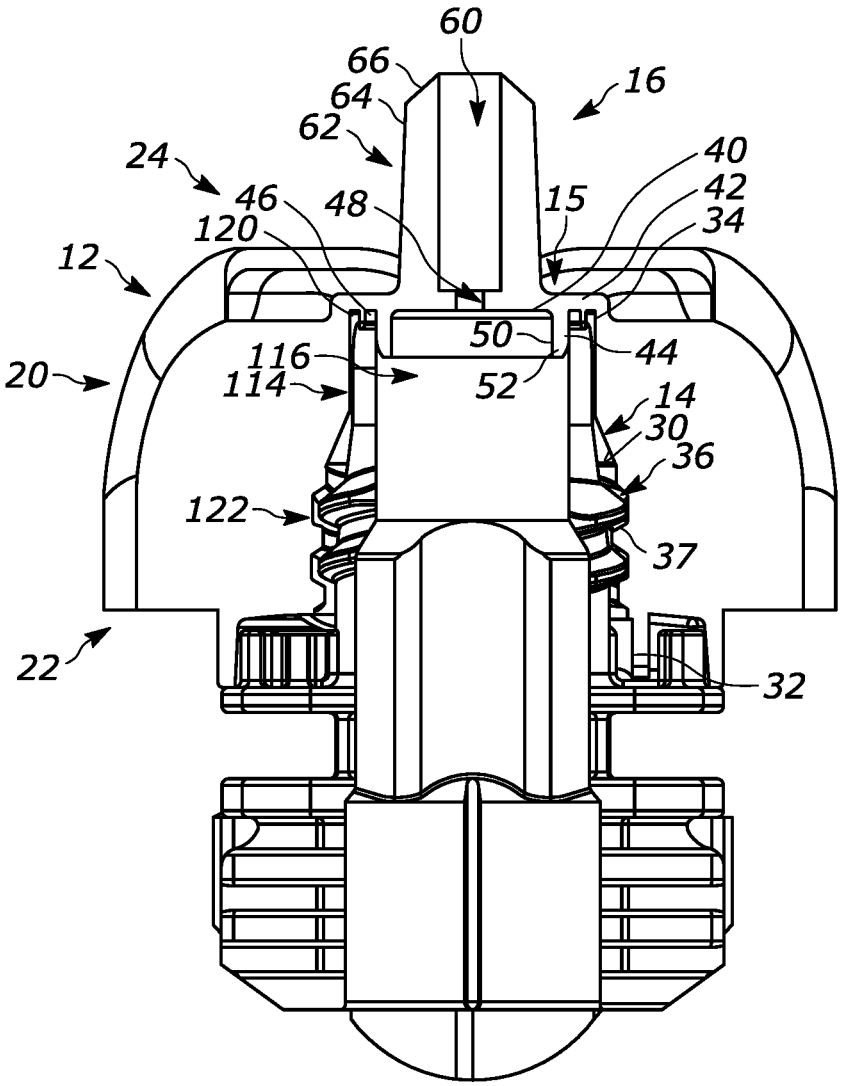
FIG. 7 of the drawings is a partial cross-sectional view of an exemplary dispensing cap coupled to a pouch structurally configured for use in association with the enteral feeding system of the present disclosure, showing, in particular, the coupling of the spout of the pouch with the spout engaging bore and the spout engaging end of the dispensing cap.

With reference to FIG. 5 through 7, dispensing cover 18 is shown as defining bore 68. The dispensing cover 18 is configured so that the elongated bore of the dispensing coupling 16 can be sealed by the dispensing cap. The dispensing cover 18 is coupled to the dispensing cap through a tether, such as tether 19 which has a first end 70 at the grasping body and a second end 72 at the dispensing cap.

As can be appreciated from FIG. 5, grasping body, the dispensing cap and the tether 19 can all be integrally molded together with each other. As such, it will be understood that the tether has the flexibility to be bent and to resist returning to the original configuration when the cover is positioned over the elongated bore. In other configurations, the tether 19 may comprise another material, such as a flexible rubber material, a thread or woven cable-like material.

Figure 10:
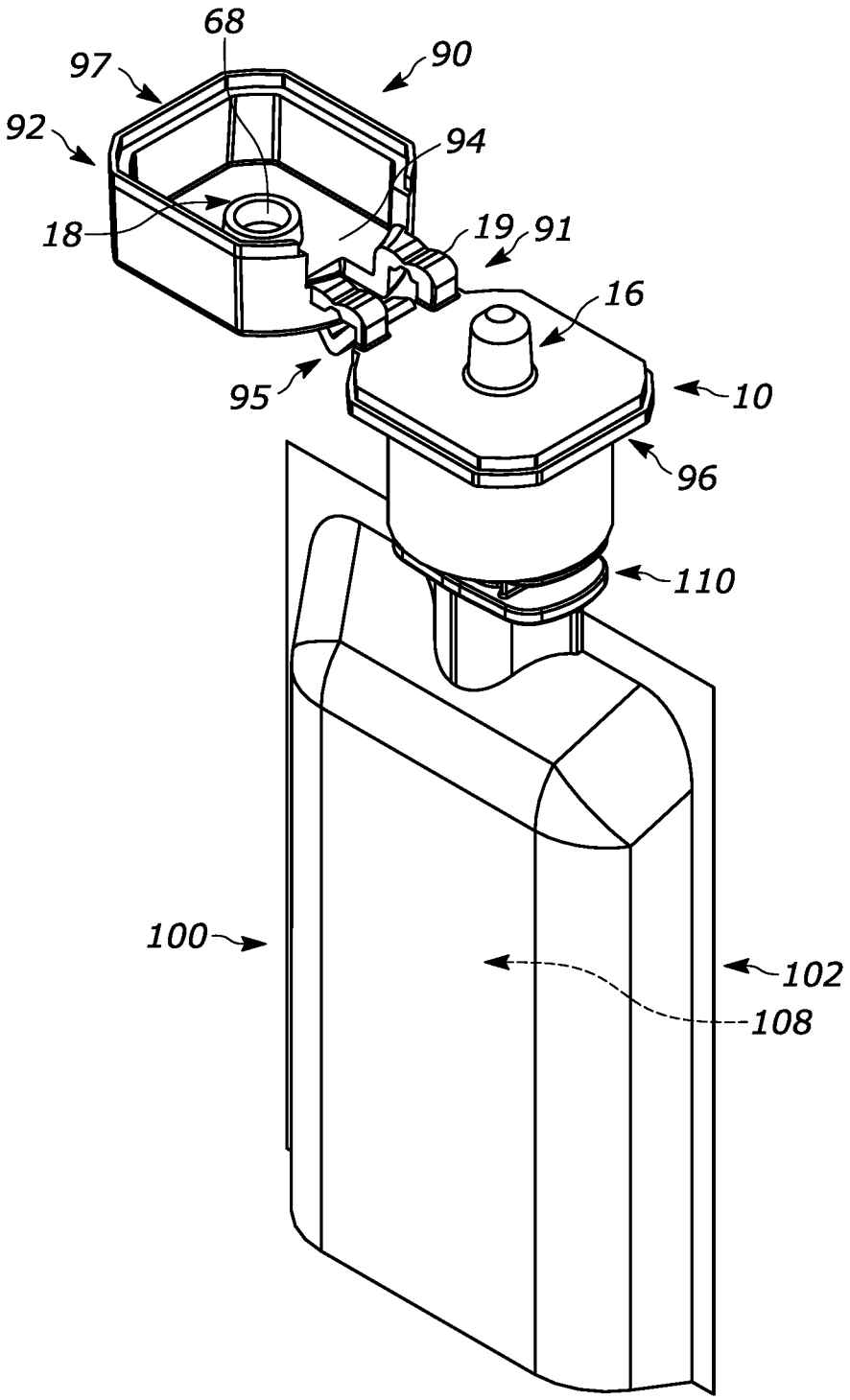
FIG. 10 of the drawings is a perspective view of another exemplary dispensing cap of the present disclosure as coupled to a pouch, showing an alternative of the grasping body and showing a flip-top cap with the dispensing cover and tether incorporated into a live hinge so that the flip-top cap can have single hand operation to open and close the same, allowing the other hand to be utilized to couple an outside structure, such as a syringe or feeding tube to the dispensing cap.
Figure 11:
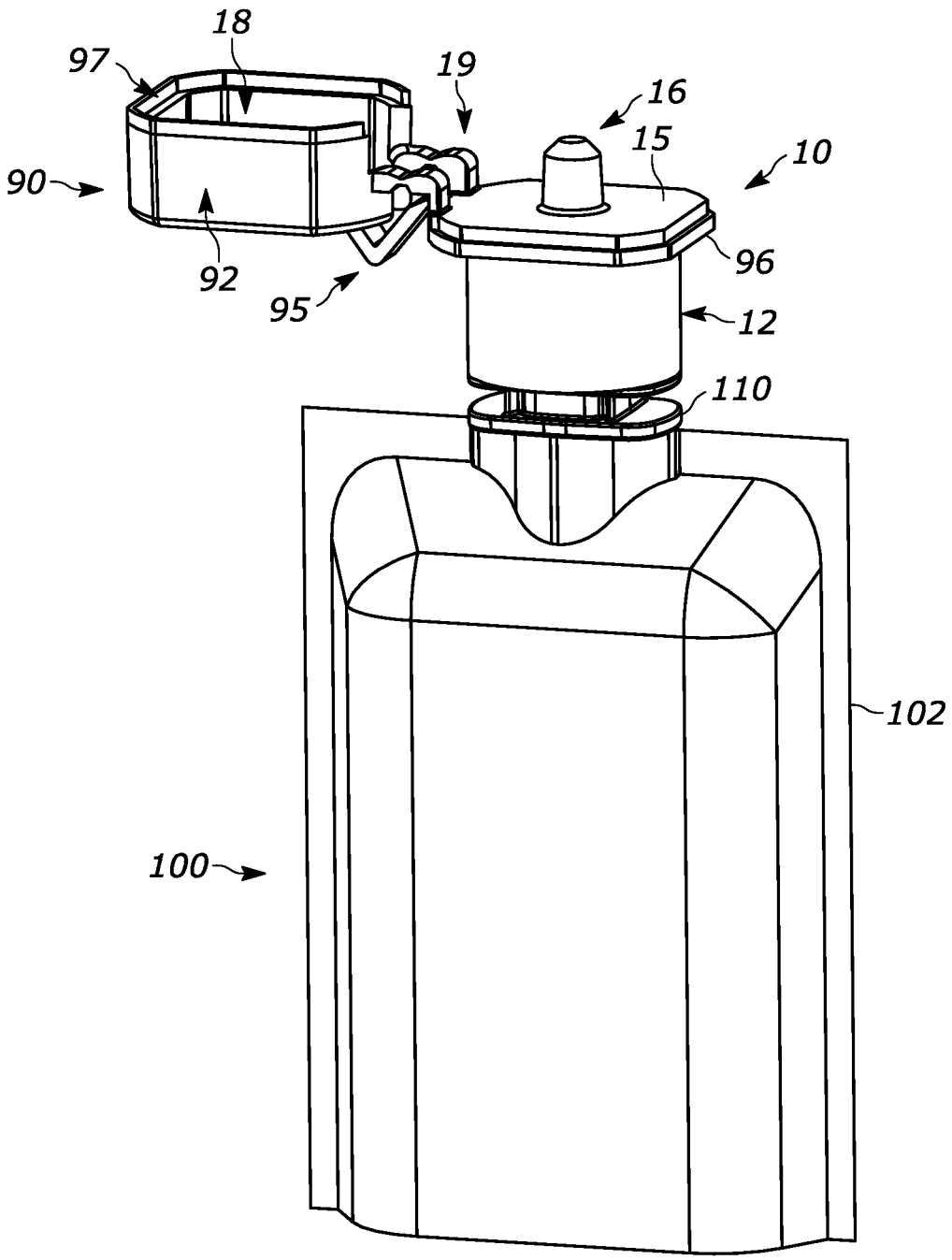
FIG. 11 of the drawings is another perspective view of the exemplary dispensing cap coupled to a pouch as is shown in FIG. 10.

In still other configurations, and with reference to FIGS. 10 and 11, the dispensing cover may comprises a flip-top cover 90 which can be hingedly coupled to the grasping body through, for example, a live hinge configuration 91. Such a cover may include a larger cover 92 that matingly engages with and forms a portion of the grasping body when in the closed configuration, and which can flip open about the live hinge for example, to open or close as desired. The bore 68 may extend from an inner surface 94 of the larger cover 92. Additional limiting or biasing members 95 may be utilized to limit the opening of the live hinge configuration 91. The spout engaging end may include an outward flange 96, in such a configuration that interfaces with the outer rim 97 of the flip-top cover 90.

In operation, to, for example, fee an infant enterally, a user is provided with a container, such as a pouch, having breast milk, formula or other nutrients, for example. Advantageously, in the pouch configuration disclosed above, such filling may have been accomplished aseptically. In other configurations, a retort process may have been utilized post fill, for example. It will be understood that while the process is particularly useful as a system in an aseptic fill environment, the process is not limited thereto.

First, in the aseptic environment, typically, the pouch or container will have a first cap installed at the time of filling, and, the dispensing cap 10 can be provided in a separate sterilized package. The user can remove the dispensing cap 10 from the sterilized package. Once removed, the user can remove the cap that is covering the pouch 100. Once removed, the user can apply the dispensing cap 10 to the pouch 100. The user can connect the dispensing cover 18 to the dispensing coupling prior to fitting the dispensing cap to the pouch to minimize the possibility of squeezing or otherwise disrupting the pouch which may cause the loss of some of the contents through the spout. In the case of the flip-top cover, the cover can be in the closed orientation prior to and during the attachment thereof to the spout.

Preferably, to attach the dispensing cap and to remove the other cap, the user can grasp and retain the spout, and to allow the remainder of the pouch body to be free from contact and/or grasping.

Figure 12:
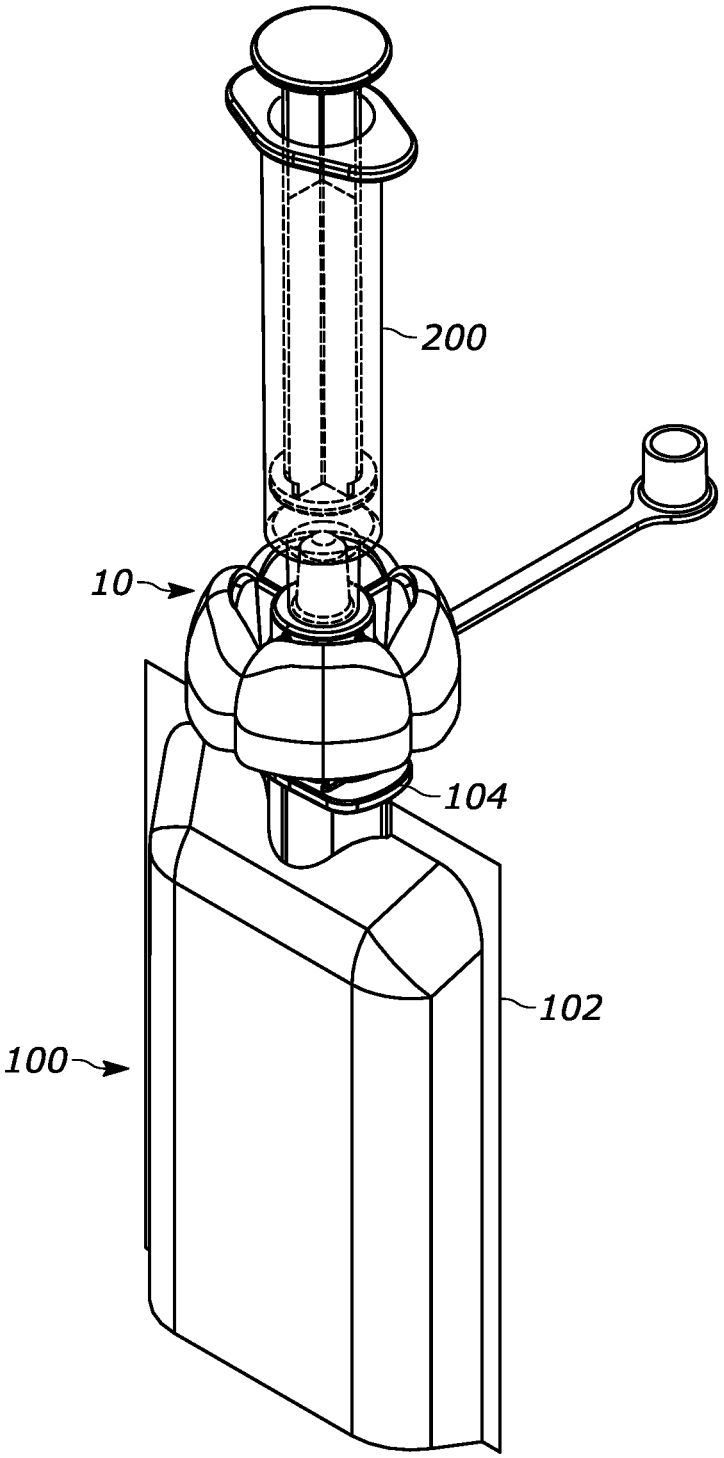
FIG. 12 of the drawings is a perspective view of an exemplary pouch and dispensing cap wherein the dispensing cap is coupled to a syringe which can draw fluid from the volume of the pouch through the spout and dispensing cap.

Once the dispensing cap has been attached to the spout, the user can couple the dispensing coupling to an outside structure. For example, and with reference to FIG. 12, a syringe 200 (having a mating coupling to the dispensing coupling, such as, for example, and without limitation, an EnFit coupling) can be attached to the dispensing coupling so that the inner volume of the syringe is in fluid communication with the elongated bore 60, the outlet opening 48, and, in turn, the volume 108 of the pouch.

The syringe can be drawn to fill the volume of the pouch. Such a syringe may be filled with anywhere between 2 ml and 35 ml, for example, while more or less fill is contemplated. At the same time, the pouch volume can be reduced through the pulling of fluid, or thorough careful compression of the pouch. In some configurations, the pouch can remain right side up (with the spout above the pouch body) or can be flipped upside down, so that the pouch body is above the spout. Other configurations between these are likewise contemplated.

Once the desired amount has been dispensed into the syringe, the user can disconnect the syringe. The user can then apply the dispensing cover 18 over the elongated bore of the dispensing coupling 16.

Figure 13:
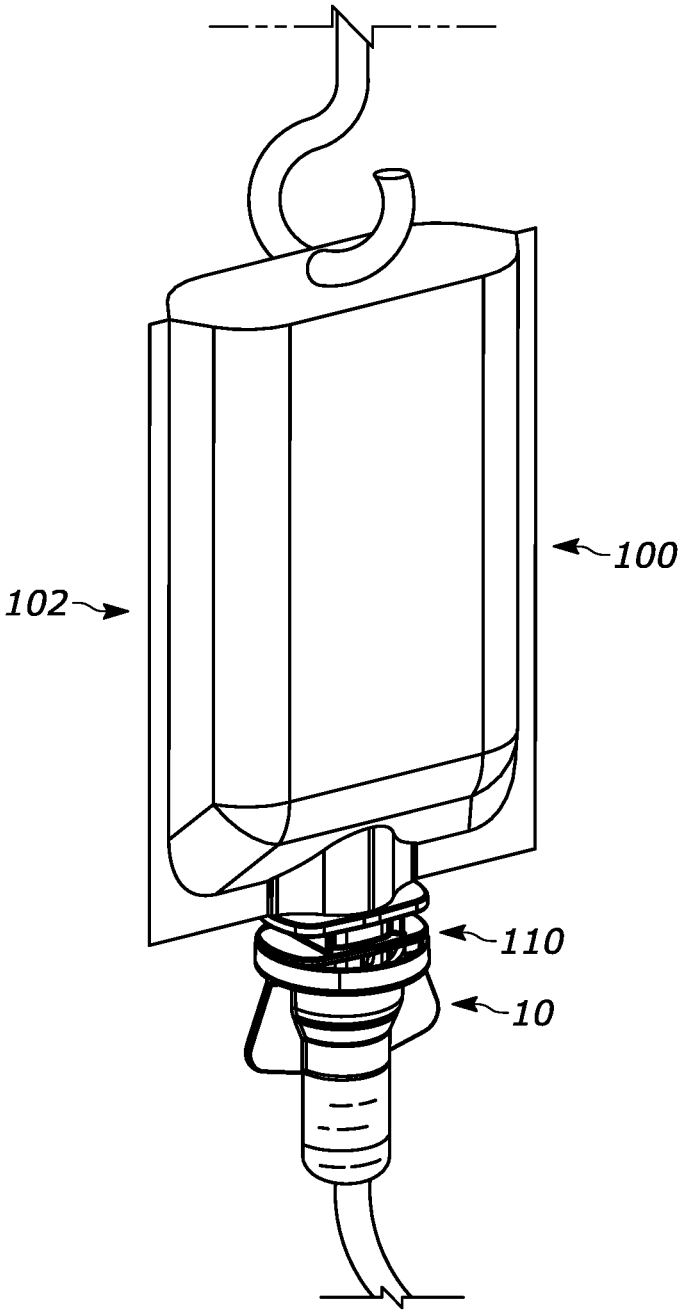
FIG. 13 of the drawings is a perspective view of an exemplary pouch and dispensing cap suspended from a hook or the like in an upside down configuration, wherein the dispensing coupling of the dispensing cap is coupled to a feeding tube.
Figure 14:
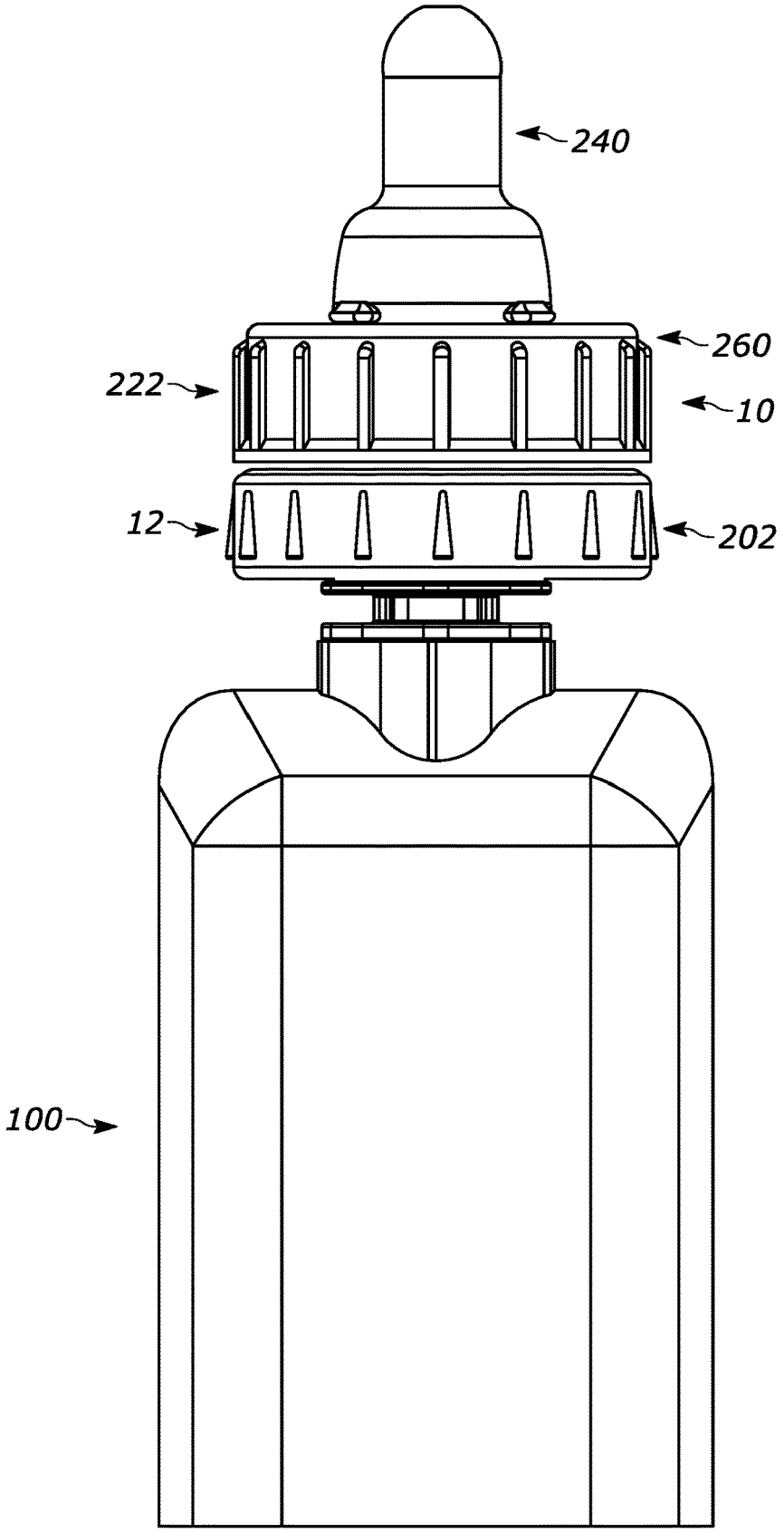
FIG. 14 of the drawings is a front plan view of the pouch showing a nipple assembly configured therewith.
Figure 15:
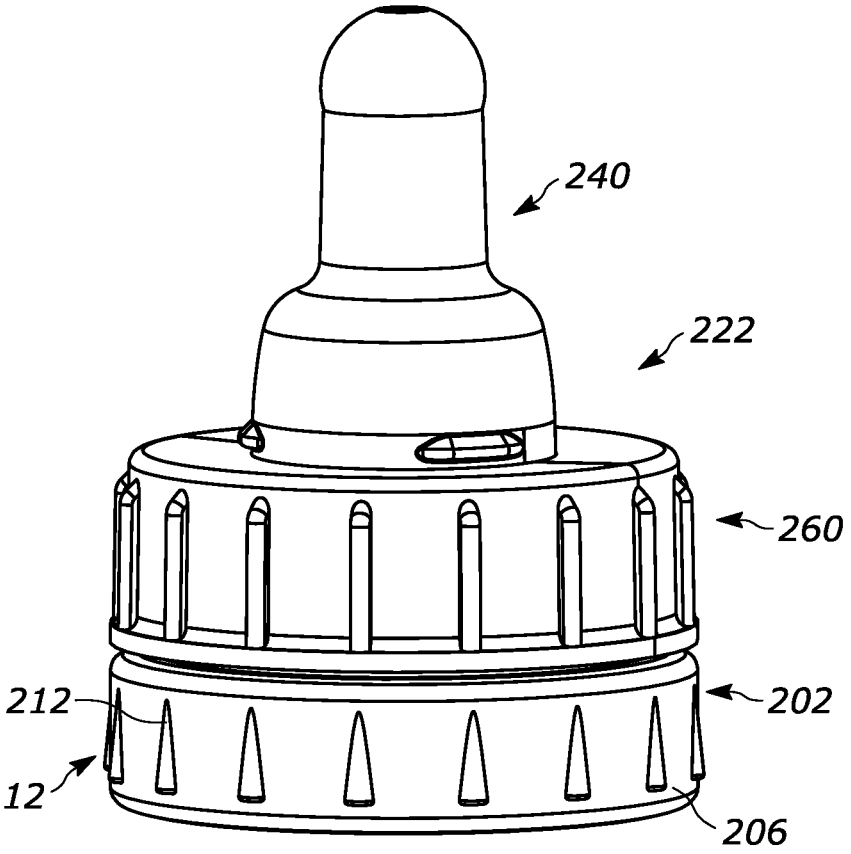
FIG. 15 of the drawings is a perspective view of the dispensing cap, and the nipple assembly.
Figure 16:
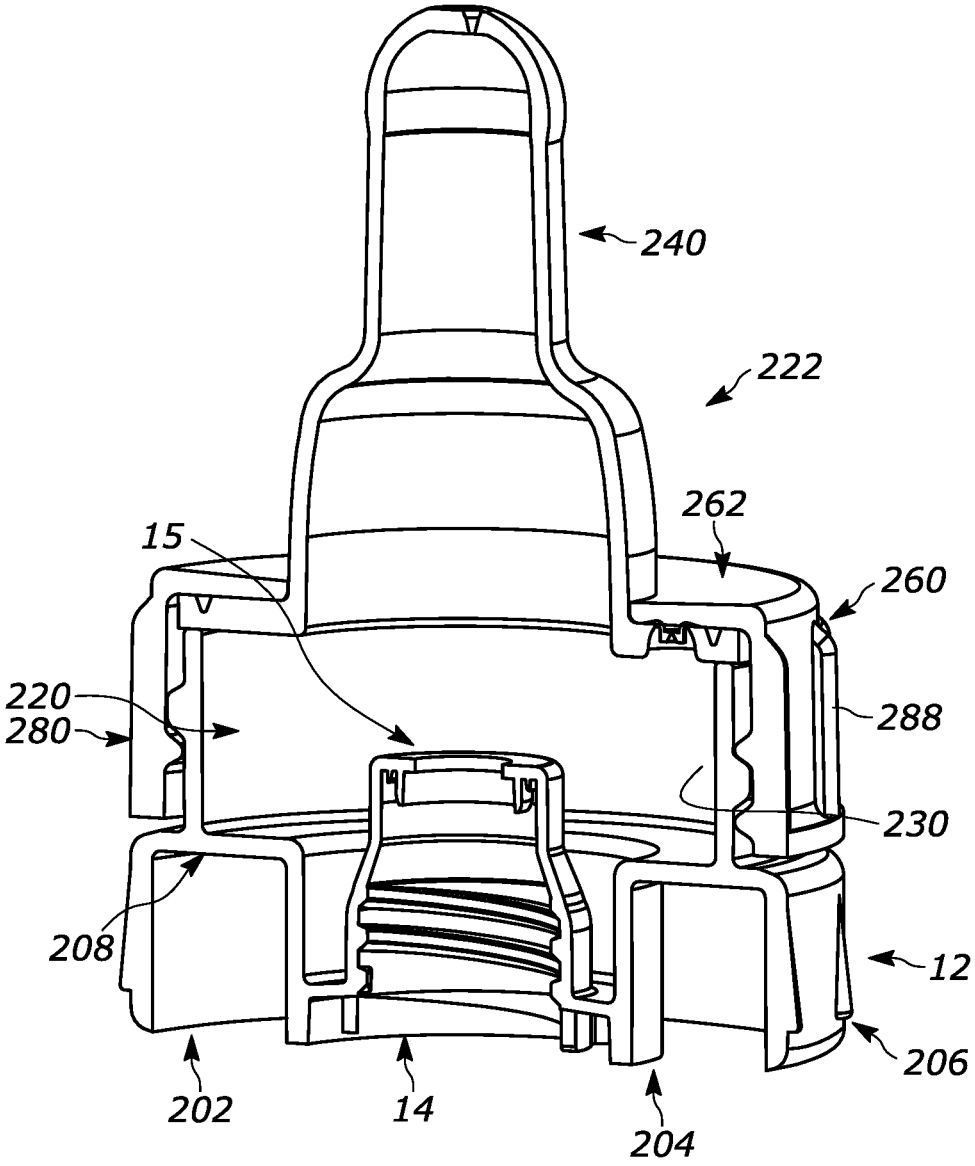
FIG. 16 of the drawings is a perspective cross-sectional view of the dispensing cap and the nipple assembly.
Figure 17:
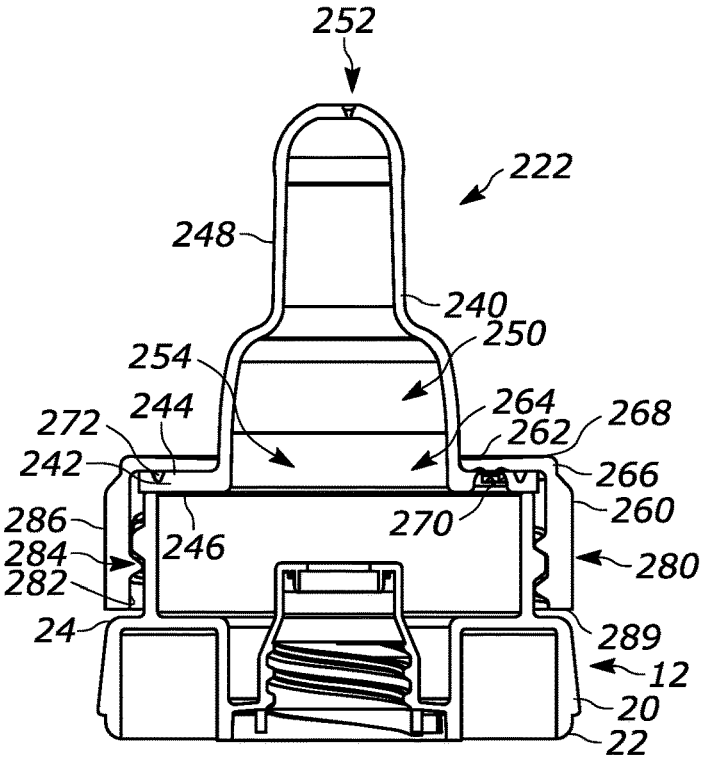
FIG. 17 of the drawings is a cross-sectional view of the dispensing cap and the nipple assembly.
Figure 18:
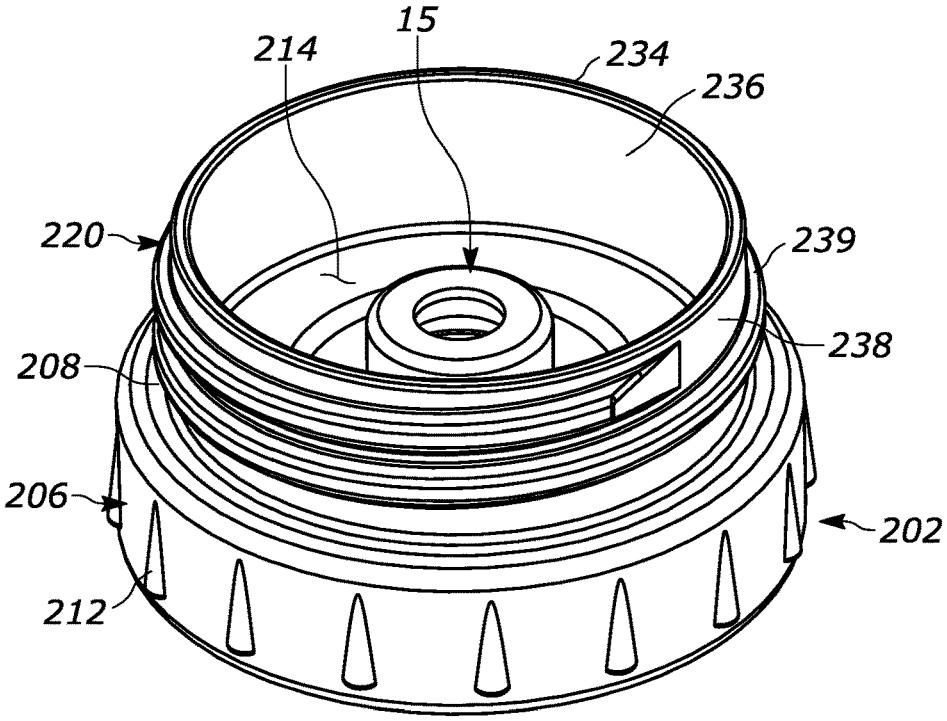
FIG. 18 of the drawings is a perspective view of the dispensing cap showing the upstanding wall of the auxiliary coupling.
Figure 19:
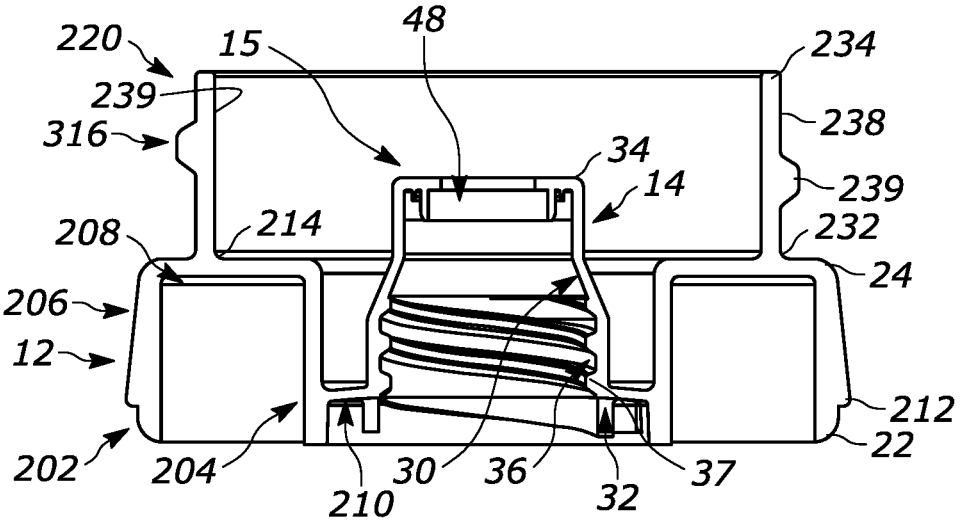
FIG. 19 of the drawings is a cross-sectional view of the dispensing cap showing the upstanding wall of the auxiliary coupling.

In other configurations, a feeding tube having an EnFit coupling, for example (and without limitation), can be directly attached to, for example, the dispensing cap, an example of which is shown in FIG. 13. Additionally, the pouch can be elevated so that the pouch can be dispensed through gravity. In some such examples, the pouch can be hung from a hook or the like in an elevated position to ensure that through gravity the pouch can be dispensed directly into the feeing tube.

In any such instance, once completed, the user can disconnect a syringe, a feeding tube or another structure from the dispensing cap 18 and the dispensing cover can be reapplied to seal the volume of the pouch. The pouch can then be stored in, for example, a refrigerator, if desired, without the fear of losing product through the spout. Additionally, as the pouch volume can be reduced during dispensing, the ingress of air or other fluids from the outside can be limited, thereby further reducing the possibility of introducing microbes or pathogens into the volume of the pouch.

While the system is utilizeable with other types of containers, the use thereof with pouches, bags or other containers which can change in volume has the advantage of minimizing the ingress of fluids and gasses during the dispensing process.

It will be understood that the different types of dispensing couplings, the different types of dispensing covers and the different types of tethers can be varied between the different configurations and interchanged to form a number of different variations. In addition, the pouch of the present disclosure may be replaced with a differently configured package, including, but not limited to a flexible package or the like. Furthermore, the particular fluids that are contained within the pouch can be varied, and those that are disclosed are merely disclosed as exemplary and are not intended to be limiting.

For example, and as shown in FIG. 14 through 19, a nipple member, such as nipple member 240 which can attached to the spout 110. Such a configuration can be attached to a pouch after the pouch is opened and a cover is removed. While this is preferred, it is also contemplated that an all-in-one solution can be provided wherein the nipple can be installed or permanently coupled to the spout, and a protective cover may be positioned over the nipple.

In one configuration which is meant to be illustrative and not limiting, the dispensing cap configuration includes grasping body 12 having a spout engaging bore 14 and a spout engaging end 15, as well as an auxiliary coupling 230 and a nipple assembly 222. As set forth in other configurations, the grasping body provides a user the structure by which to grasp and retain the dispensing cap. In the configuration of FIGS. 14*a* through 14*e*, the grasping body includes annular hoop 202 which includes an upper end 22 and a lower end 24. The annular hoop 202 includes inner wall 204, outer wall 206 and annular wall 208. The inner wall 204 is radially spaced apart from the spout engaging bore 14 and coupled thereto by way of the inner connecting flange 210 which is spaced apart from both the lower end 22 and the upper end 24 (and slightly inclined upwardly between the inner wall and the spout engaging bore so as to direct any fluids away from the spout engaging bore). Additionally, such a configuration defines a trough surrounding the spout engaging bore formed by the outer surface of the spout engaging bore in combination with the inner connecting flange 210 and the inner wall 204.

The outer wall 206 is spaced apart from the inner wall, and is coupled thereto by way of the annular wall 208. The annular wall 208 includes upper surface 214. The outer wall, in the configuration shown, corresponds in configuration to the depending wall 280 or the nipple assembly so that the two substantially match from a standpoint of diameter. Of course, variations are contemplated, however, such a configuration allows for selectively grasping one or both of the structures simultaneously as desired.

It is preferred that the grasping body is molded along with the spout engaging bore and the spout engaging end. In the configuration shown, the spout engaging bore substantially matches previously described configurations set forth above. The spout engaging end, in the configuration shown terminates the spout engaging bore. The nipple assembly provides an alternative dispensing coupling which is attached to the grasping body through the auxiliary coupling.

In the configuration shown, the auxiliary coupling is formed together with the grasping body 12 and includes upstanding wall 230. In the configuration, the upstanding wall 230 is substantially parallel to the inner wall and the outer wall of the annular hoop and perpendicular to the annular wall. The upstanding wall extends upwardly away from the upper surface 214 of the annular wall in a direction opposite of the inner and outer walls of the annular hoop. The upstanding wall 230 includes lower end 232, upper end 234, which defines an upper rim, inner surface 236 and outer surface 238.

The nipple assembly 222 is shown in FIGS. 14 through 21*b* as comprising nipple member 240 and retention ring 260. The nipple member comprises a flexible molded member (formed from a molded flexible polymer) 240 includes base flange 242, and upper funnel portion 248. The base flange includes top surface 244 and bottom surface 246, and the upper funnel portion 248 extends therefrom and defines cavity 250. The cavity 250 has an upper opening 252 and a lower opening 254 that is formed at or near the mating of the base flange and the upper funnel portion. Of course, any number of different configurations are contemplated for the upper funnel portion.

The retention ring 260 includes upper wall 262, and depending wall 280. As will be understood, the retention ring is threaded onto the upstanding wall so as to sandwich the nipple member, and in particular the base flange 242 of the nipple member, therebetween. The upper wall 262 of the retention ring 260 includes central opening 264, outer perimeter 266, upper surface 268, lower surface 270. The lower surface includes lower nub 272 which further facilitates the sealing of the nipple member. The depending wall 280 includes inner surface 282, outer surface 286 and lower end 189. The inner surface 282 includes threads that matingly engage the threads of the outer surface of the upstanding wall 230. The outer surface 286 includes grasping ribs 288 which facilitate grasping and manipulating of the retention ring by a user. The retention ring may comprise a molded polymer that is resilient (and may be from a polymer that is similar, identical to, or distinct from the polymer from which the dispensing cap is formed). Typically, the nipple member is of a more flexible and compressible material so as to be elastically deformable between the retention ring and the upstanding wall.

Figure 20:
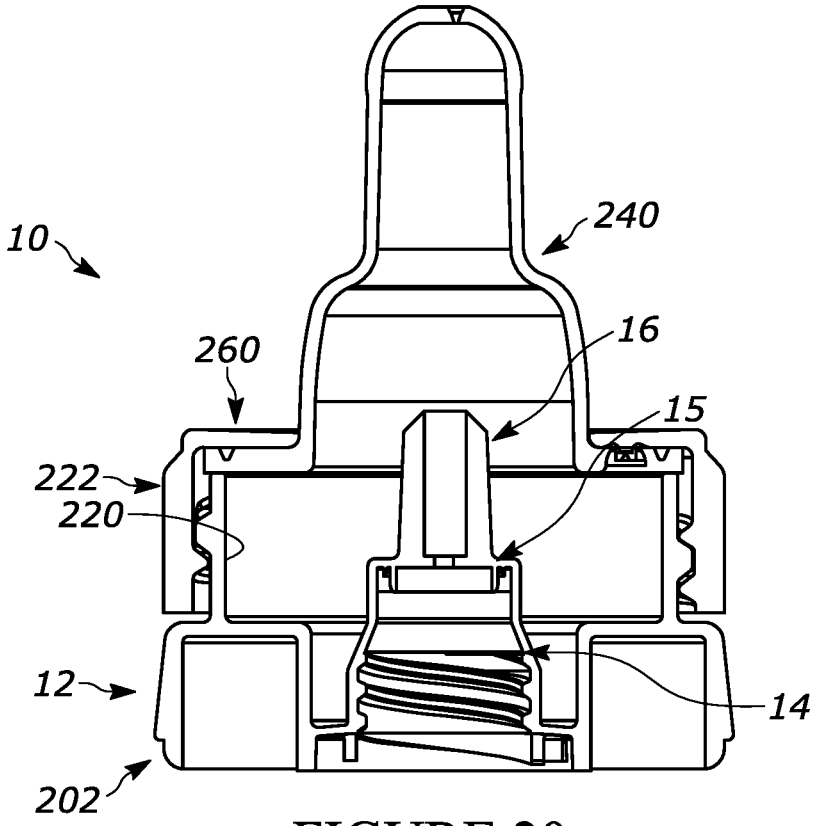
FIG. 20 of the drawings is a cross-sectional view of another configuration of the dispensing cap having an auxiliary coupling and nipple assembly along with an additional dispensing coupling.
Figure 21:
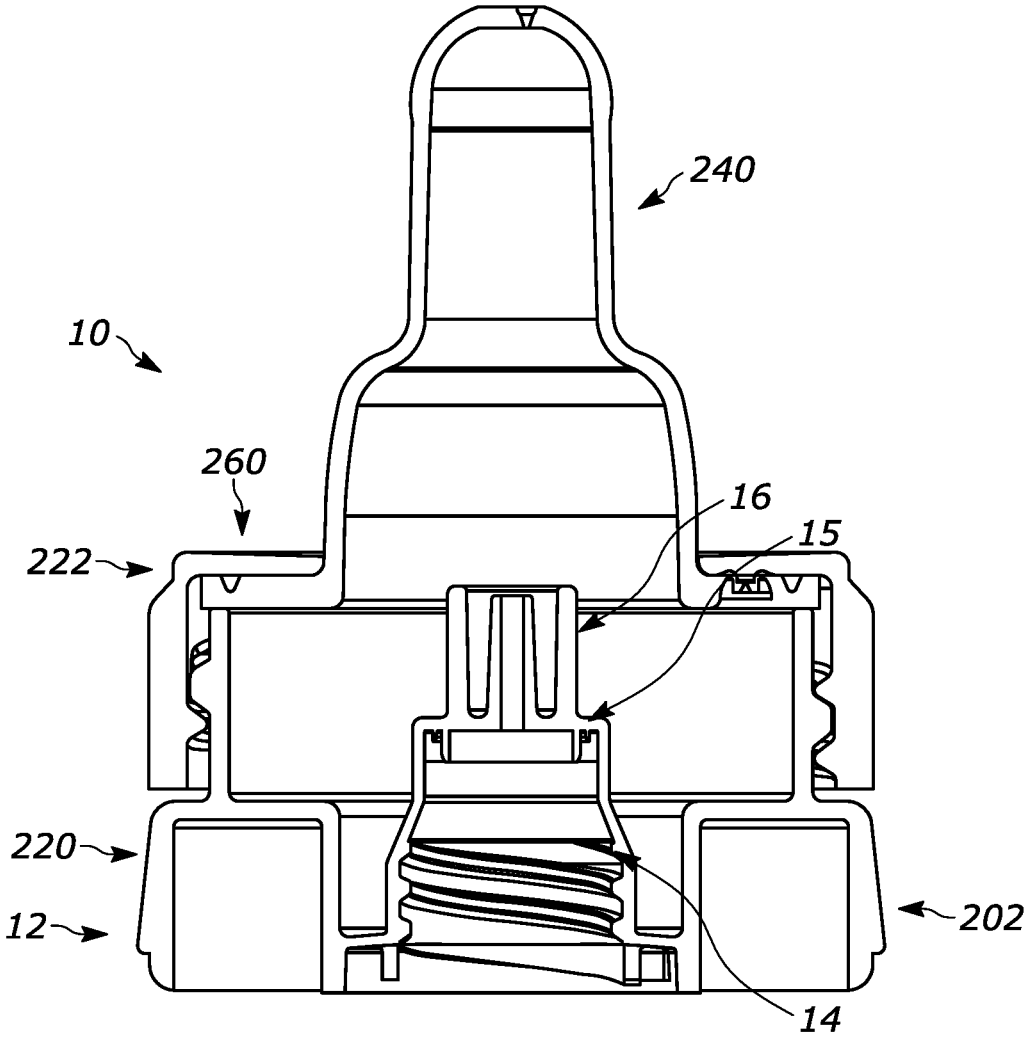
FIG. 21 of the drawings is a cross-sectional view of another configuration of the dispensing cap having an auxiliary coupling and nipple assembly along with an additional dispensing coupling.
Figure 22:
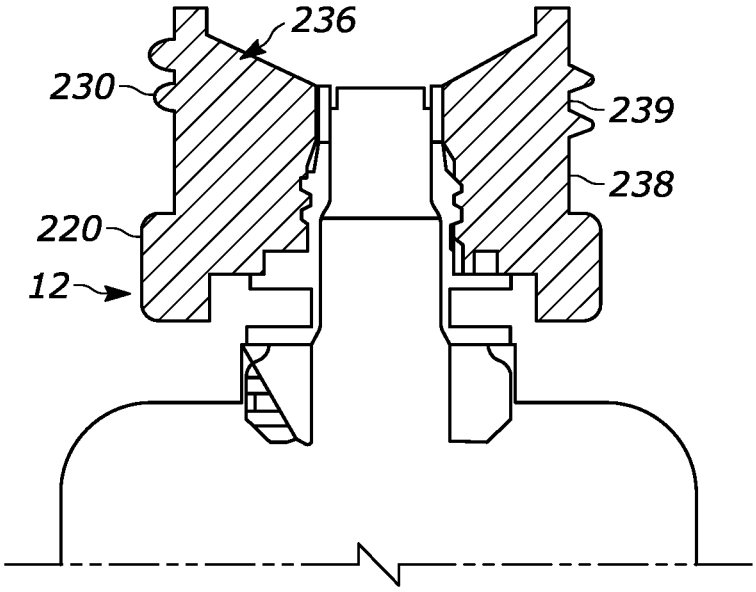
FIG. 22 of the drawing is a cross-sectional configuration of another configuration of the dispensing cap having a nipple assembly.
Figure 23:
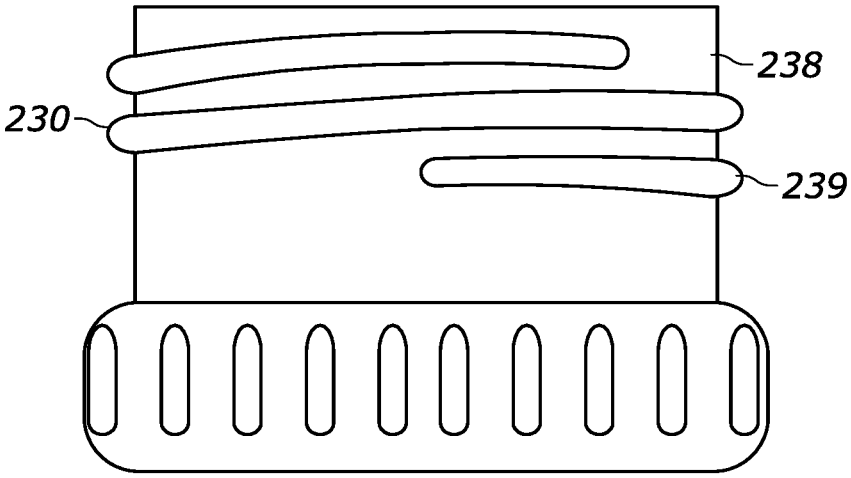
FIG. 23 of the drawings is a side elevational view of the configuration of FIG. 22.

It will be understood that while an opening is shown at the spout engagement end, in some configurations, another dispensing coupling 16 (such as the outlet surface or outer shell of the configurations of FIGS. 1 through 13) can be additionally configured on the spout engagement end. In such a configuration, the single dispensing cap may be able to receive either the nipple assembly 222 or an EnFit coupling of various types (among other structures and couplings). Two such configurations are shown in FIGS. 20 and 21, each showing a different EnFit coupling, one of which includes the elongated bore, and one of which further includes an outer shell. In the configuration of FIGS. 22 and 23, the upstanding wall 230 of the auxiliary coupling may include an surface 236 that is conical and/or inclined inwardly toward the spout engaging bore, and which surface may be pinching the same so as to create a substantially fluid tight joint, so as to minimize crevices into which fluids can pass. Additionally, the remainder of the body follows the contours of the spout to minimize additional crevices and to improve dishwasher and/or cleaning performance of the nipple assembly and the auxiliary coupling and the dispensing cap.

It will further be understood that such nipple assemblies can be single use/disposable such that after use, the entire pouch with the nipple assembly may be tossed or discarded.

Figure 24:
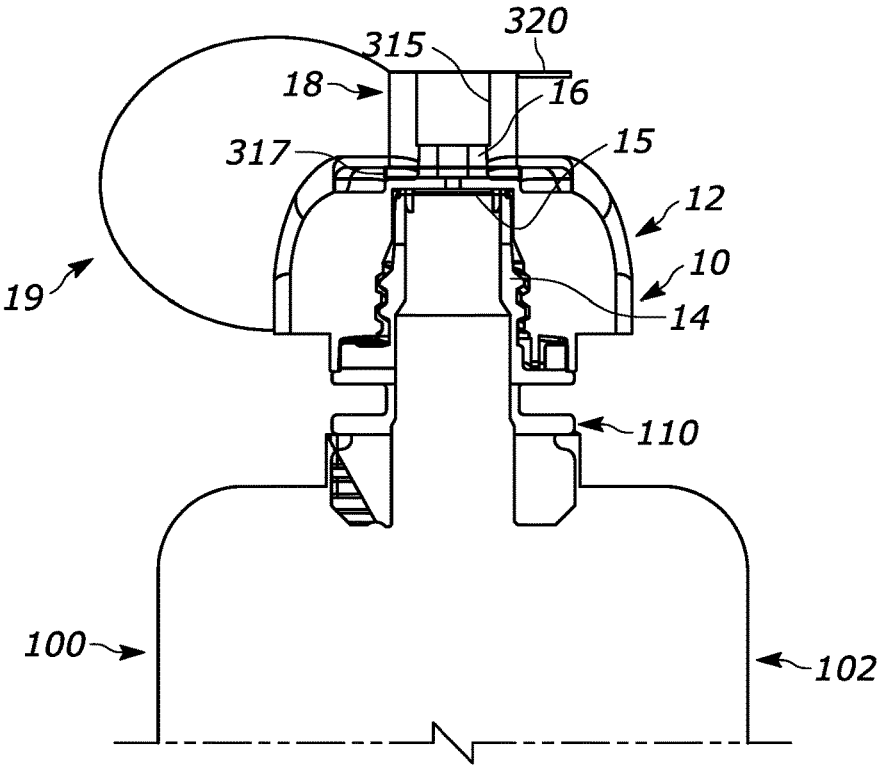
FIG. 24 of the drawings is another configuration of the pouch and dispensing cap showing a break away seal among other features.
Figure 25:
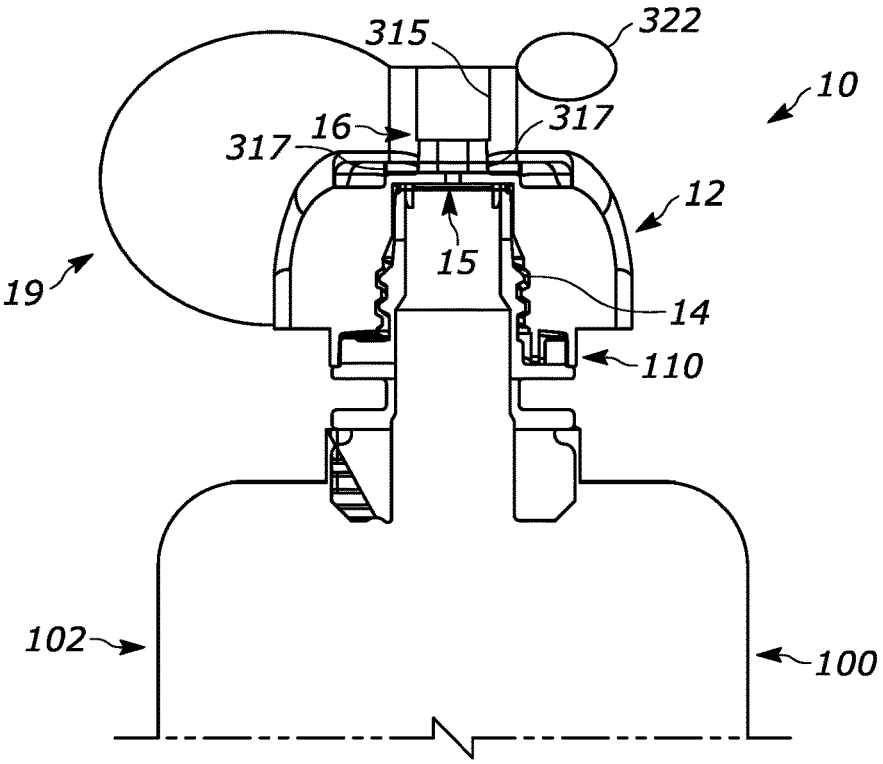
FIG. 25 of the drawings is another configuration of the pouch and dispensing cap showing a break away seal among other features.

In other configurations, it is further contemplated that an all-in-one solution of a spout may be provided wherein the desired dispensing coupling is on the dispensing cap and the dispensing cap is provided at the time of filling. In such configurations, a pressure fit seal 315 may be applied and a dispensing cover can be tethered to the dispensing cap, and a break away seal 317 can be applied over the cap to body interface, which seal can be frangible and can be broken in a number of different manners. One such configuration is shown in FIG. 24 with a flat finger lip 320, and in FIG. 25 with a finger pull ring 322.

Figure 26:
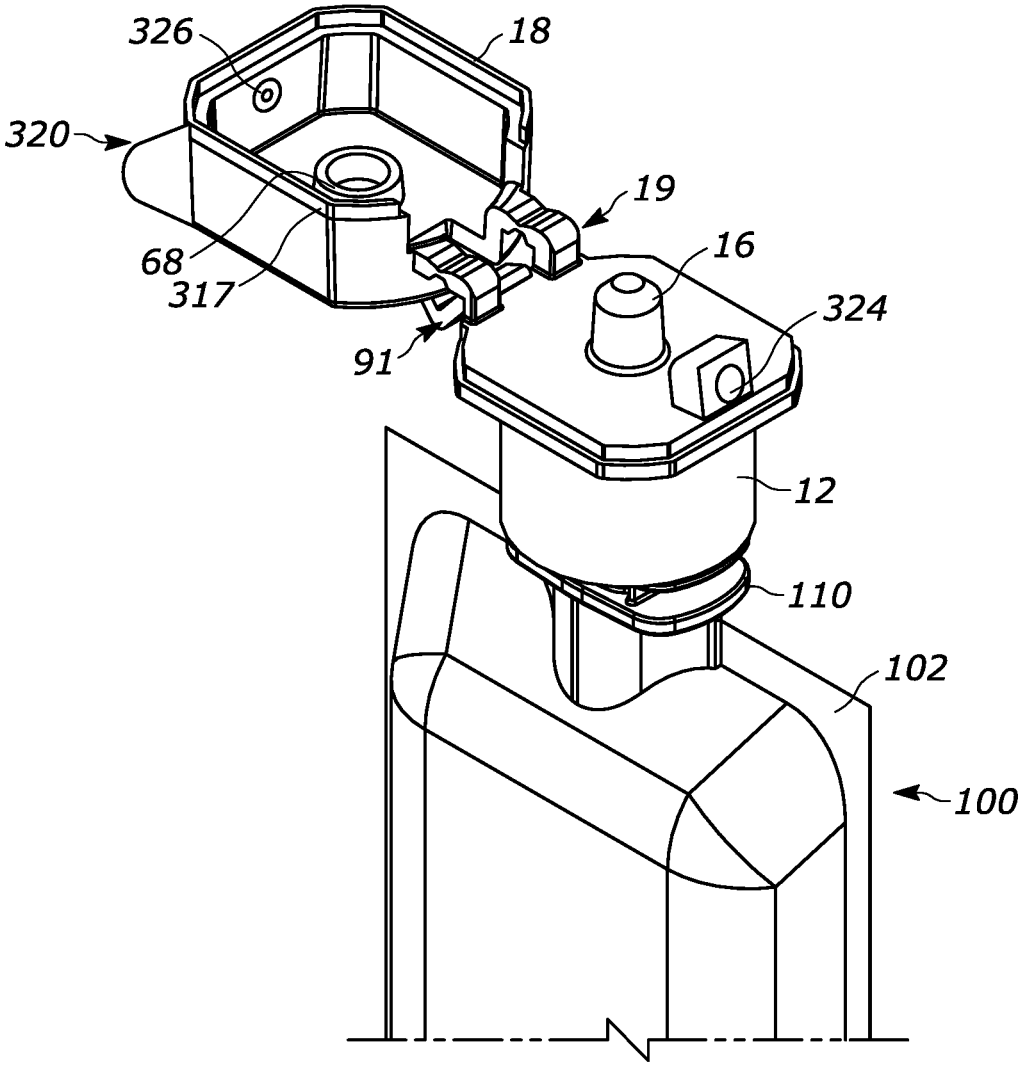
FIG. 26 of the drawings is another configuration of the pouch and dispensing cap showing a live hinge coupled flip cap.
Figure 27:
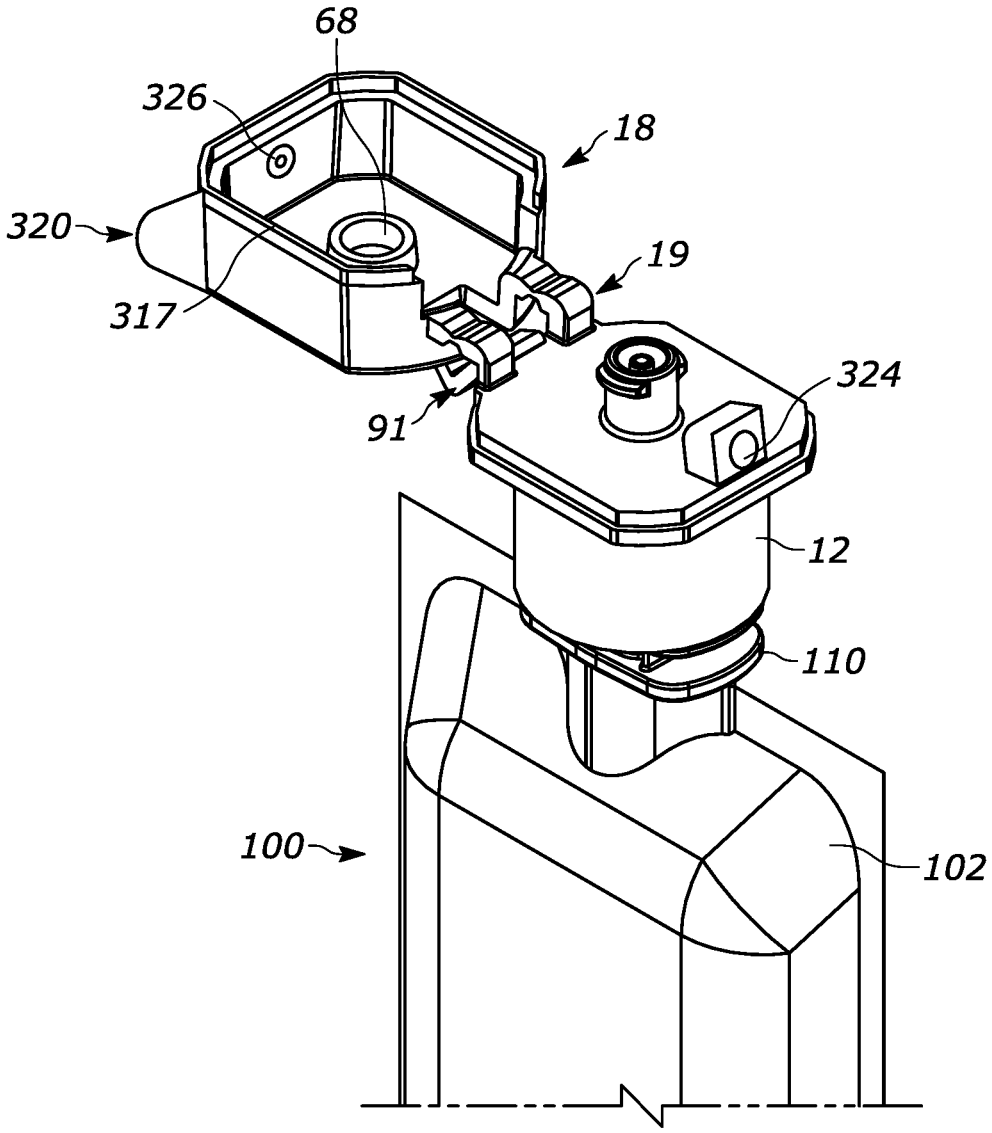
FIG. 27 of the drawings is another configuration of the pouch and dispensing cap showing a live hinge coupled flip cap.
Figure 28:
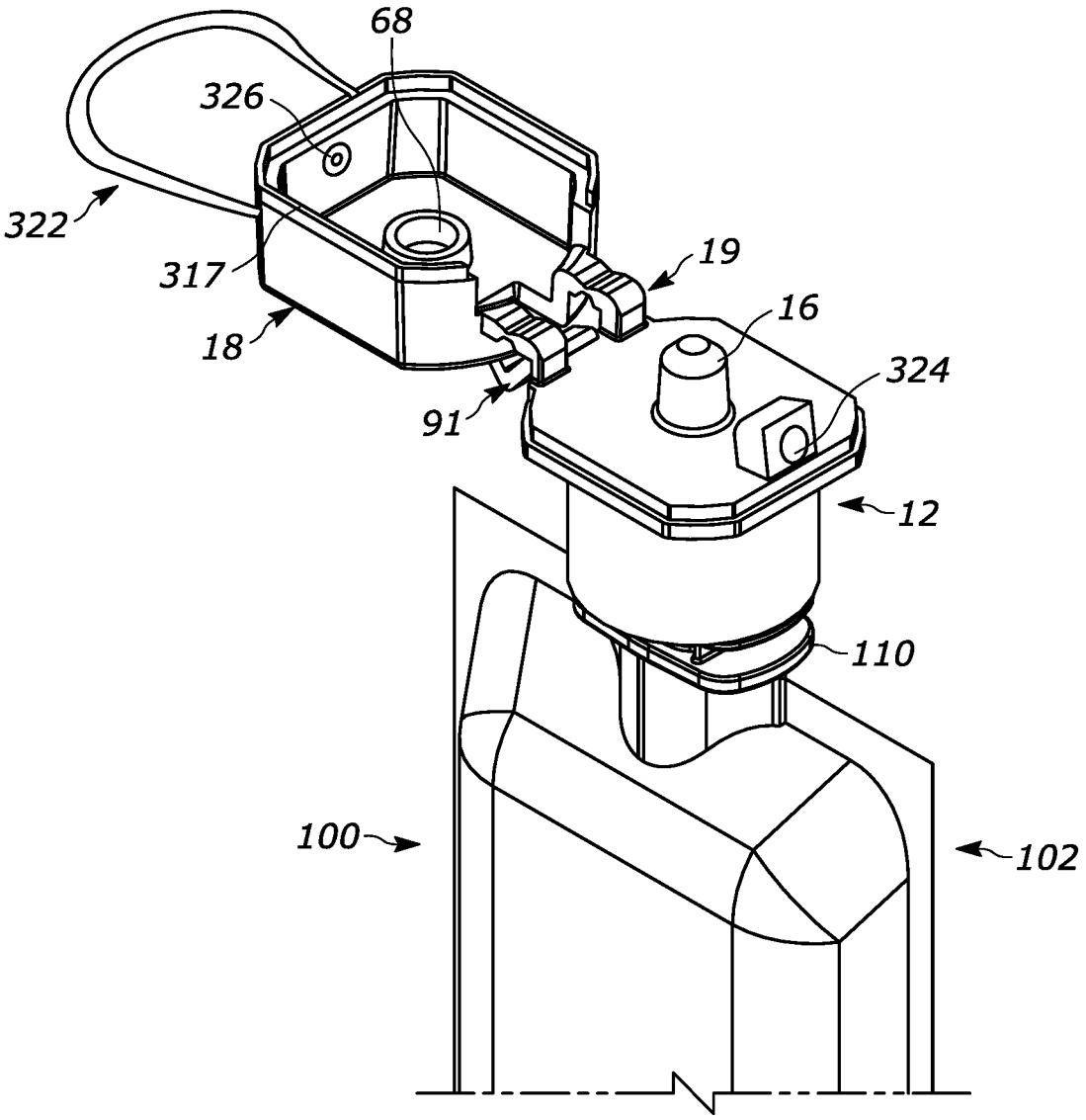
FIG. 28 of the drawings is another configuration of the pouch and dispensing cap showing a live hinge coupled to a flip cap.
Figure 29:
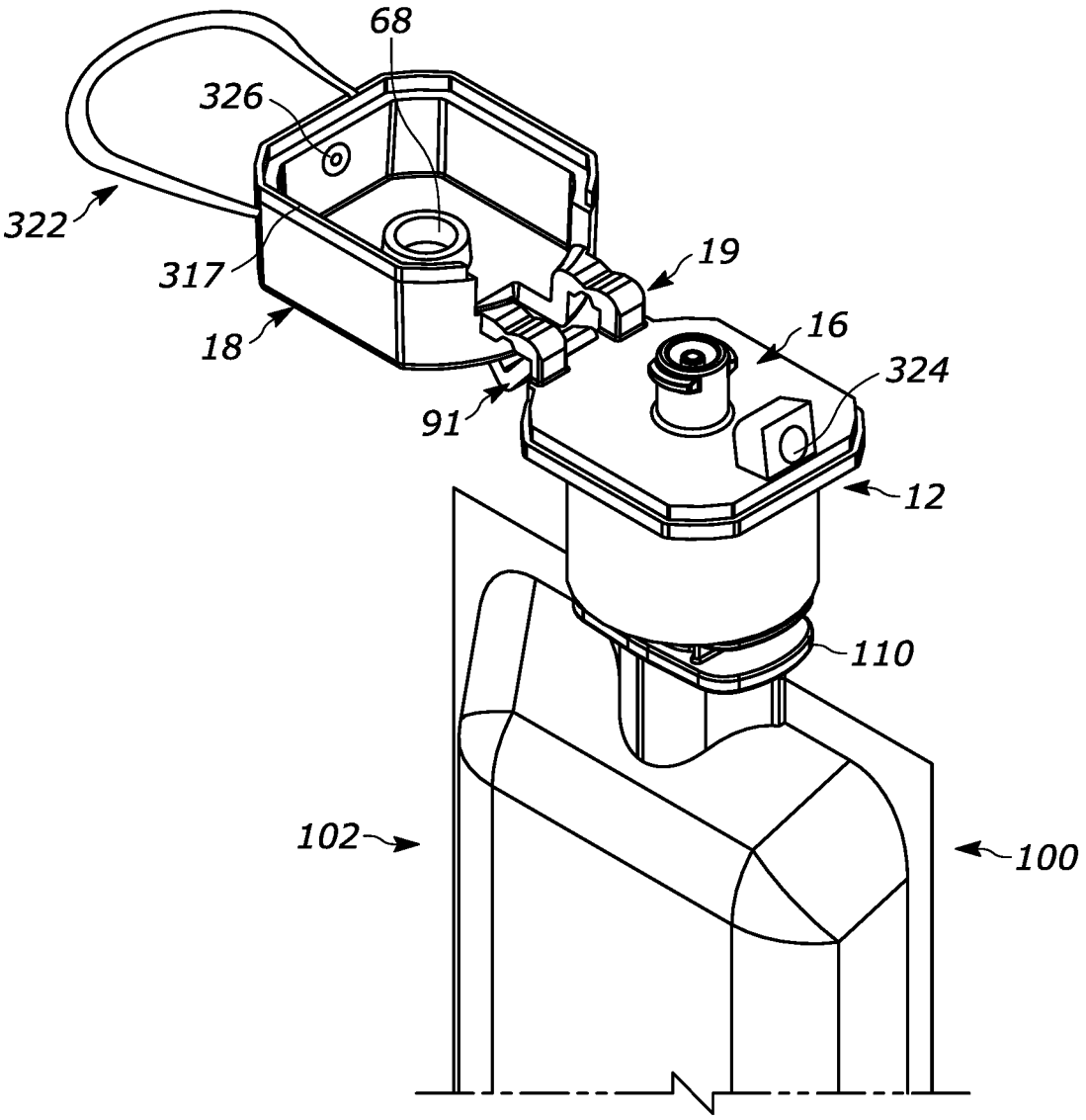
FIG. 29 of the drawings is another configuration of the pouch and dispensing cap showing a live hinge coupled to a flip cap.

Another such configuration, showing a flip top with a flat finger coupling is shown in FIGS. 26 and 27. In such a configuration, the inner seal cylinder (i.e., the bore 68) can be pressure fit. A bump and indentation 324 can be utilized to maintain the closure by interfacing with a bump 326 on the dispensing cover. Additionally, a break away seal 328 can surround the entirety of the cap. A similar configuration is shown in FIGS. 28 and 29, with a pull ring. It will be understood that such configurations can be utilized with a number of different dispensing couplings.

Among other advantages and features, the foregoing disclosure provides a substantially closed system and can enhance aseptic technique by protecting contents and facilitating aseptic transfer when filling syringes from the pouch which may be filled in an aseptic configuration. Furthermore, the configuration allows for the dispensing of fluid from a single container. The enteral feeding system of the present disclosure when utilized in the manners disclosed follows to the ADA and ASPEN guidelines on aseptic handling of human breast milk. Furthermore, it is contemplated that the dispensing caps protect contents and facilitate closed system aseptic transfer when filling syringes. In the configurations disclosed, the dispensing cap can be covered with the dispensing cap so as to provide a cost effective, easy fluid transfer system, especially as compared to conventional manners of transfer and extraction which may utilize multiple straws, for example.

It will further be understood that the at least some of the disclosure is directed to limit or eliminate breast milk exposure to air, which can be highly problematic with the use of conventional simple open style containers. As is known in the art, ambient air exposure, which can be common with standard screw style lids and bottles, can contribute to the oxidation of milk lipids and an accelerated rate of bacteria colonization within the fluid.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A dispensing cap for attachment to a pouch, the dispensing cap comprising:

a grasping body having an outer surface;

a spout engaging bore having an outer surface and an inner surface, with the inner surface including an inner thread structurally configured to be engageable a spout of a pouch;

a spout engaging end extending from the bore and having an outlet opening that is in fluid communication with the spout, and in turn, the volume;

wherein the grasping body further includes and an annular hoop surrounding the spout engaging end, the annular hoop including an inner wall and an outer wall concentric with the inner wall and an annular wall joining the inner wall and the outer wall at an upper end of each of the inner wall and the outer wall, with an upstanding wall extending from the annular wall terminating at an upper rim, and including an outer surface, with a body thread positioned along the outer surface, and further including an inner connecting flange extending between the inner wall, spaced apart from each of the upper end and a lower end thereof, and the outer surface of the spout engaging bore; and a nipple assembly comprising:

a nipple member including a base flange and an upper funnel portion defining an upper opening and a lower opening; and a retention ring having an upper wall with a lower surface and a central opening; and a depending wall depending from the upper wall and including a retaining thread, wherein, the retention ring in cooperation with the upstanding wall sandwich the nipple member therebetween, while placing the upper opening and the lower opening in fluid communication with the outlet opening of the spout engaging bore.

2. The dispensing cap of claim 1 wherein the inner wall, the outer surface of the spout engaging bore and the inner connecting flange define a trough that extends about the spout engaging bore.

3. The dispensing cap of claim 2 wherein the depending wall of the retention ring and the outer wall of the annular hoop are substantially annularly aligned and wherein a lower end of the depending wall meets the upper end of the outer wall at the annular wall.

4. The dispensing cap of claim 1 wherein the spout engaging end is positioned so as to terminate between a lower end of the upstanding wall and an upper end of the upstanding wall.

5. The dispensing cap of claim 1 wherein the central opening has a diameter and the inner wall has a diameter the diameter of the inner wall substantially corresponding to the diameter of the central opening, such that the entirety of the of the spout engaging bore is below the central opening.

6. The dispensing cap of claim 1 further comprising a dispensing coupling extending from the spout engaging end, the dispensing coupling having an elongated bore with an outer surface, the outer surface including a frustoconical portion and a beveled portion at a distal end thereof.

7. The dispensing cap of claim 6 wherein the dispensing coupling further includes an outer shell extending around the outer surface.

8. The dispensing cap of claim 7 wherein the dispensing coupling extends beyond an upper end of the upstanding wall, so as to extend into the nipple, upon placement of the nipple onto the upstanding wall.

9. A pouch assembly comprising:

a pouch with a pouch body being flexible and defining a volume and a spout providing fluid communication with the volume;

a dispensing cap for attachment to the pouch, the dispensing cap comprising:

a grasping body having an outer surface;

a spout engaging bore having an outer surface and an inner surface, with the inner surface including an inner thread structurally configured to be engageable the spout of the pouch;

a spout engaging end extending from the bore and having an outlet opening that is in fluid communication with the spout, and in turn, the volume;

wherein the grasping body further includes and an annular hoop surrounding the spout engaging end, the annular hoop including an inner wall and an outer wall concentric with the inner wall and an annular wall joining the inner wall and the outer wall at an upper end of each of the inner wall and the outer wall, with an upstanding wall extending from the annular wall terminating at an upper rim, and including an outer surface, with a body thread positioned along the outer surface, and further including an inner connecting flange extending between the inner wall, spaced apart from each of the upper end and a lower end thereof, and the outer surface of the spout engaging bore; and a nipple assembly comprising:

a nipple member including a base flange and an upper funnel portion defining an upper opening and a lower opening; and a retention ring having an upper wall with a lower surface and a central opening; and a depending wall depending from the upper wall and including a retaining thread, wherein, the retention ring in cooperation with the upstanding wall sandwich the nipple member therebetween, while placing the upper opening and the lower opening in fluid communication with the outlet opening of the spout engaging bore.

10. The dispensing cap of claim 9 wherein the inner wall, the outer surface of the spout engaging bore and the inner connecting flange define a trough that extends about the spout engaging bore.

11. The dispensing cap of claim 10 wherein the depending wall of the retention ring and the outer wall of the annular hoop are substantially annularly aligned and wherein a lower end of the depending wall meets the upper end of the outer wall at the annular wall.

12. The dispensing cap of claim 9 wherein the spout engaging end is positioned so as to terminate between a lower end of the upstanding wall and an upper end of the upstanding wall.

13. The dispensing cap of claim 9 wherein the central opening has a diameter and the inner wall has a diameter the diameter of the inner wall substantially corresponding to the diameter of the central opening, such that the entirety of the of the spout engaging bore is below the central opening.

14. The dispensing cap of claim 9 further comprising a dispensing coupling extending from the spout engaging end, the dispensing coupling having an elongated bore with an outer surface, the outer surface including a frustoconical portion and a beveled portion at a distal end thereof.

15. The dispensing cap of claim 14 wherein the dispensing coupling further includes an outer shell extending around the outer surface.

16. The dispensing cap of claim 15 wherein the dispensing coupling extends beyond an upper end of the upstanding wall, so as to extend into the nipple, upon placement of the nipple onto the upstanding wall.

* * * * *